US005172178A

United States Patent [19]

Oushiden et al.

[11] Patent Number: 5,172,178

[45] Date of Patent: Dec. 15, 1992

[54] IMAGE FORMING APPARATUS HAVING PAPER SIZE DETECTING MEANS

[75] Inventors: Hideshi Oushiden, Kawasaki; Norio Imada, Tokyo, both of Japan

[73] Assignee: Kabushiki Kaisha Toshiba, Kawasaki, Japan

[21] Appl. No.: 388,644

[22] Filed: Aug. 2, 1989

[30] Foreign Application Priority Data

Aug. 5, 1988 [JP] Japan ..... 63-195452

[51] Int. Cl.[5] ..... G03G 21/00

[52] U.S. Cl. ..... 355/311; 355/209

[58] Field of Search ..... 355/209, 308, 309, 311

[56] References Cited

U.S. PATENT DOCUMENTS

| | | | |
|---|---|---|---|
| 4,314,754 | 2/1982 | Shimizu et al. | 355/209 X |
| 4,406,537 | 9/1983 | Mori | 355/311 |
| 4,440,487 | 4/1984 | Miura | 355/311 |
| 4,811,051 | 3/1989 | Masuda et al. | 355/206 |
| 4,908,672 | 3/1990 | Ito | 355/311 |
| 4,933,720 | 6/1990 | Takano et al. | 355/209 |
| 5,006,895 | 4/1991 | Hashimoto et al. | 355/311 X |

FOREIGN PATENT DOCUMENTS

| | | |
|---|---|---|
| 2941647 | 5/1980 | Fed. Rep. of Germany . |
| 3219016 | 12/1982 | Fed. Rep. of Germany . |
| 3327270 | 2/1984 | Fed. Rep. of Germany . |

*Primary Examiner*—Fred L. Braun

*Attorney, Agent, or Firm*—Foley & Lardner

[57] ABSTRACT

An image forming apparatus includes an original detector for reading the size of an original, an upper sheet cassette, a lower sheet cassette, and a third sheet cassette for holding sheets of a plurality of types with different sizes, a display unit for indicating the sizes of the sheets contained in these cassettes, and a control circuit for automatically selecting the sheets corresponding to the original size, among other sheets contained in the cassettes, on the basis of the result of detection by the original detector. The control circuit controls the display unit so that the display unit indicates the sizes of all the sheets contained in the cassettes before the start of an image forming operation, and indicates only the size of the selected sheets after start of the image forming operation.

10 Claims, 23 Drawing Sheets

DETECTING POSITION

| ORIGINAL SIZE \ DETECTOR | T | | U | | V | | W | | X | | Y | | Z | |
|---|---|---|---|---|---|---|---|---|---|---|---|---|---|---|
| | 160 | 162 | 160 | 162 | 160 | 162 | 160 | 162 | 160 | 162 | 160 | 162 | 160 | 162 |
| A3 | ○ | ○ | ○ | ○ | ○ | ○ | ○ | ○ | ○ | ○ | ○ | ○ | ○ | ○ |
| B4 | ○ | ○ | ○ | ○ | ○ | ○ | ○ | ○ | ○ | ○ | ○ | ○ | × | × |
| A4-HORIZONTAL | × | ○ | × | ○ | × | ○ | × | ○ | × | ○ | × | × | × | × |
| B5-HORIZONTAL | × | ○ | × | ○ | × | ○ | × | ○ | × | × | × | × | × | × |
| A4-VERTICAL | ○ | ○ | ○ | ○ | ○ | ○ | × | × | × | × | × | × | × | × |
| B5-VERTICAL | ○ | ○ | ○ | ○ | × | × | × | × | × | × | × | × | × | × |
| A5-HORIZONTAL | × | ○ | × | ○ | × | ○ | × | × | × | × | × | × | × | × |
| A5-VERTICAL | × | ○ | × | × | × | × | × | × | × | × | × | × | × | × |

FIG. 12

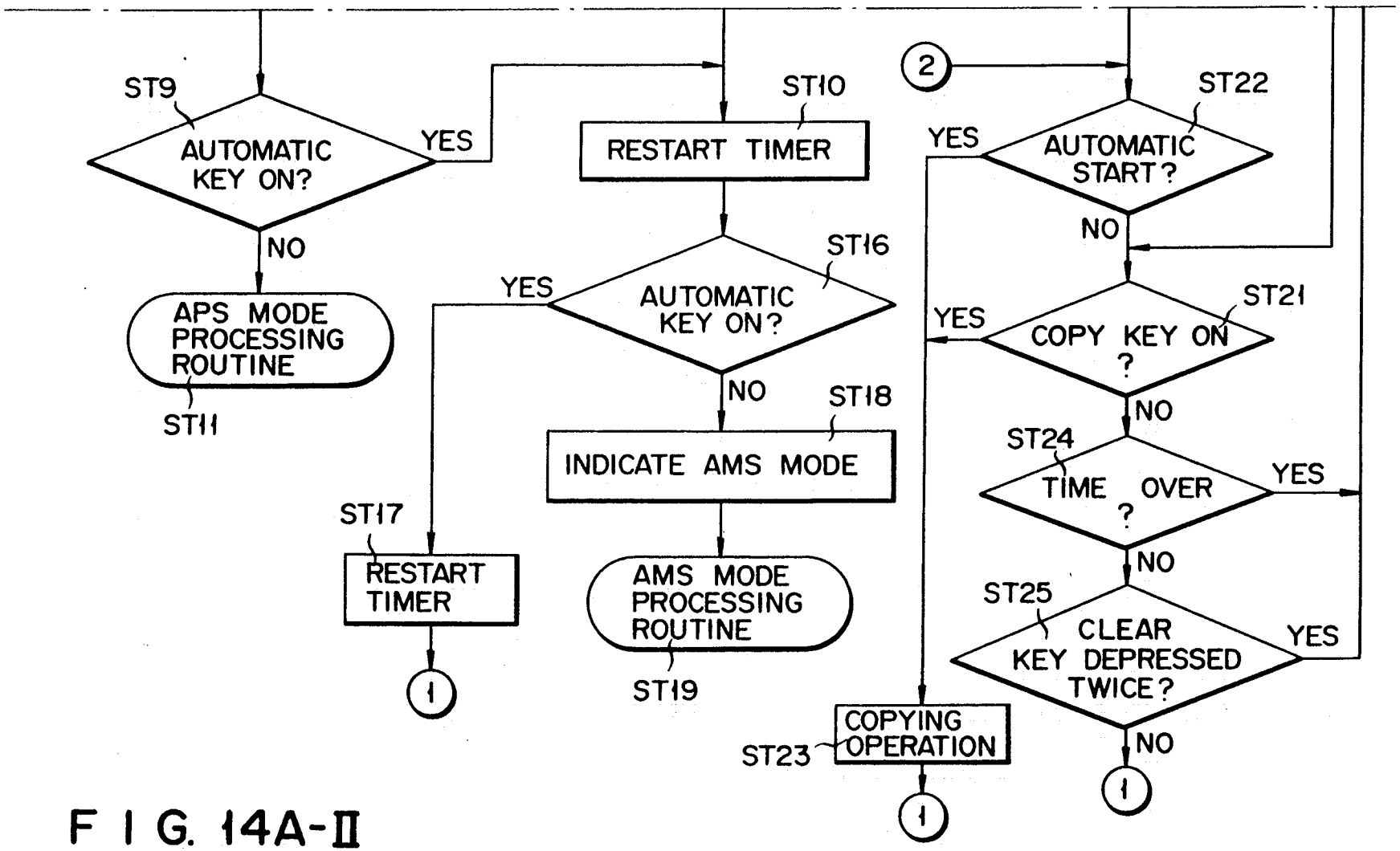
FIG. 14A-II

FIG. 14C-II
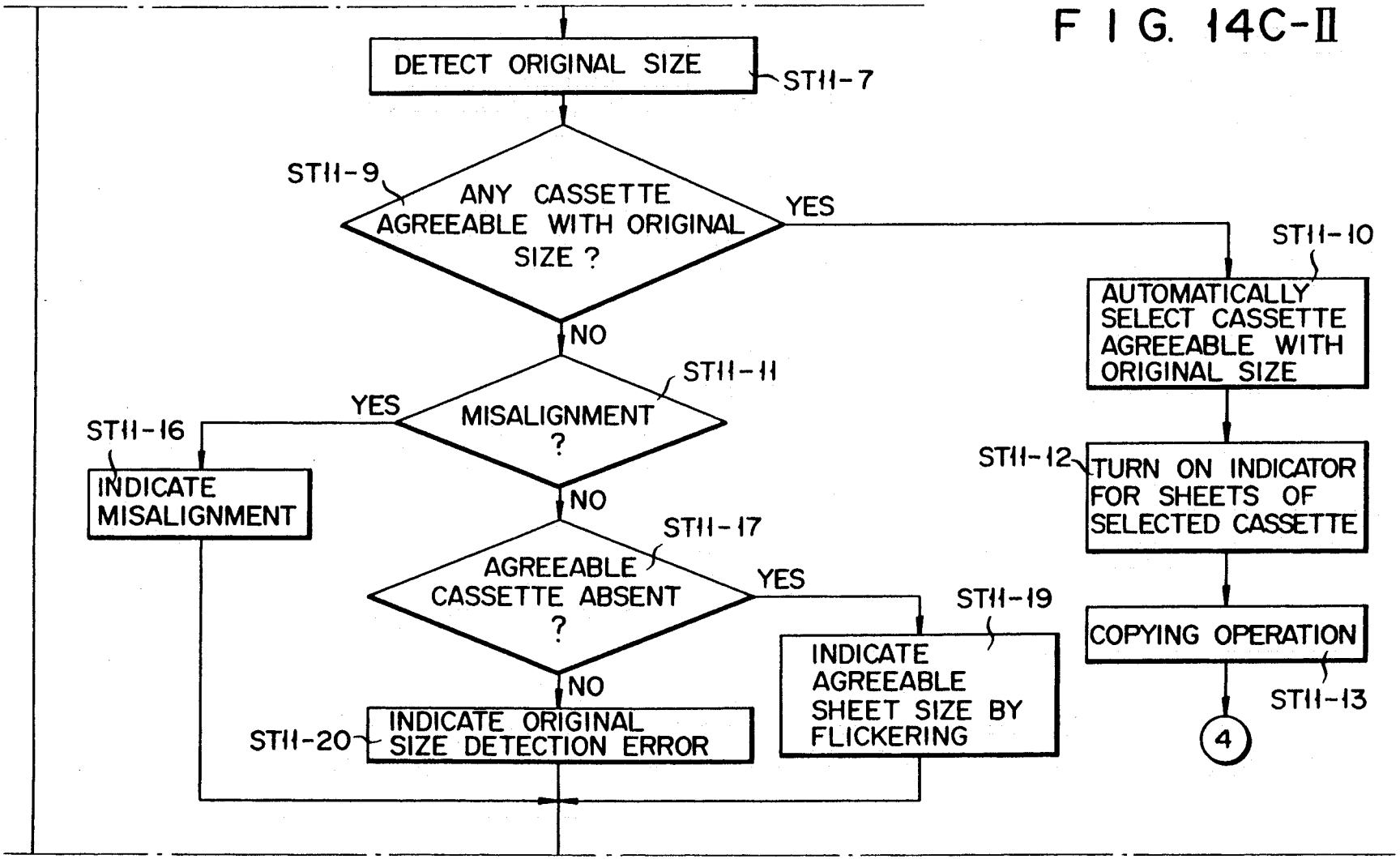

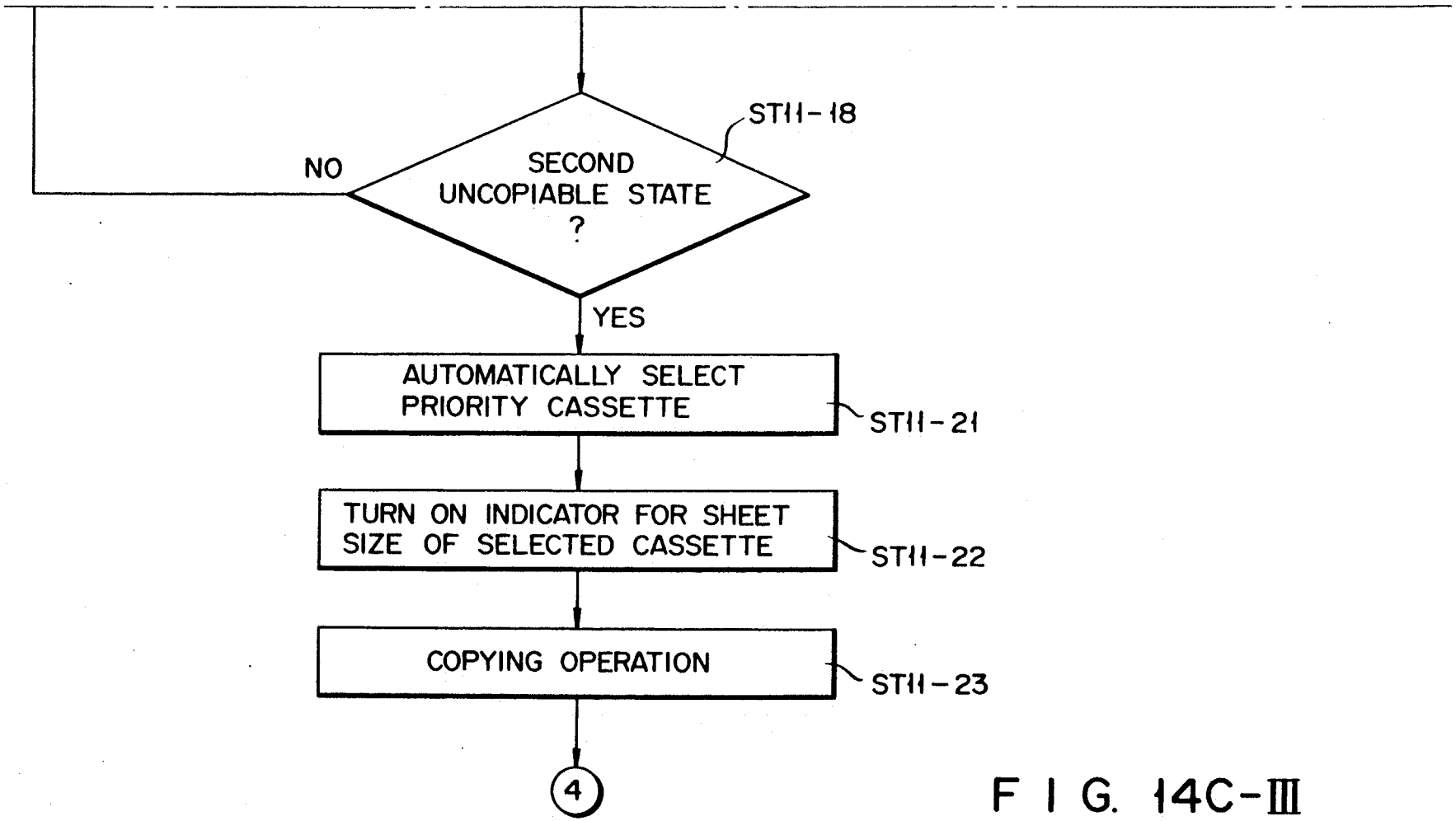
FIG. 14C-III

FIG. 14D-II
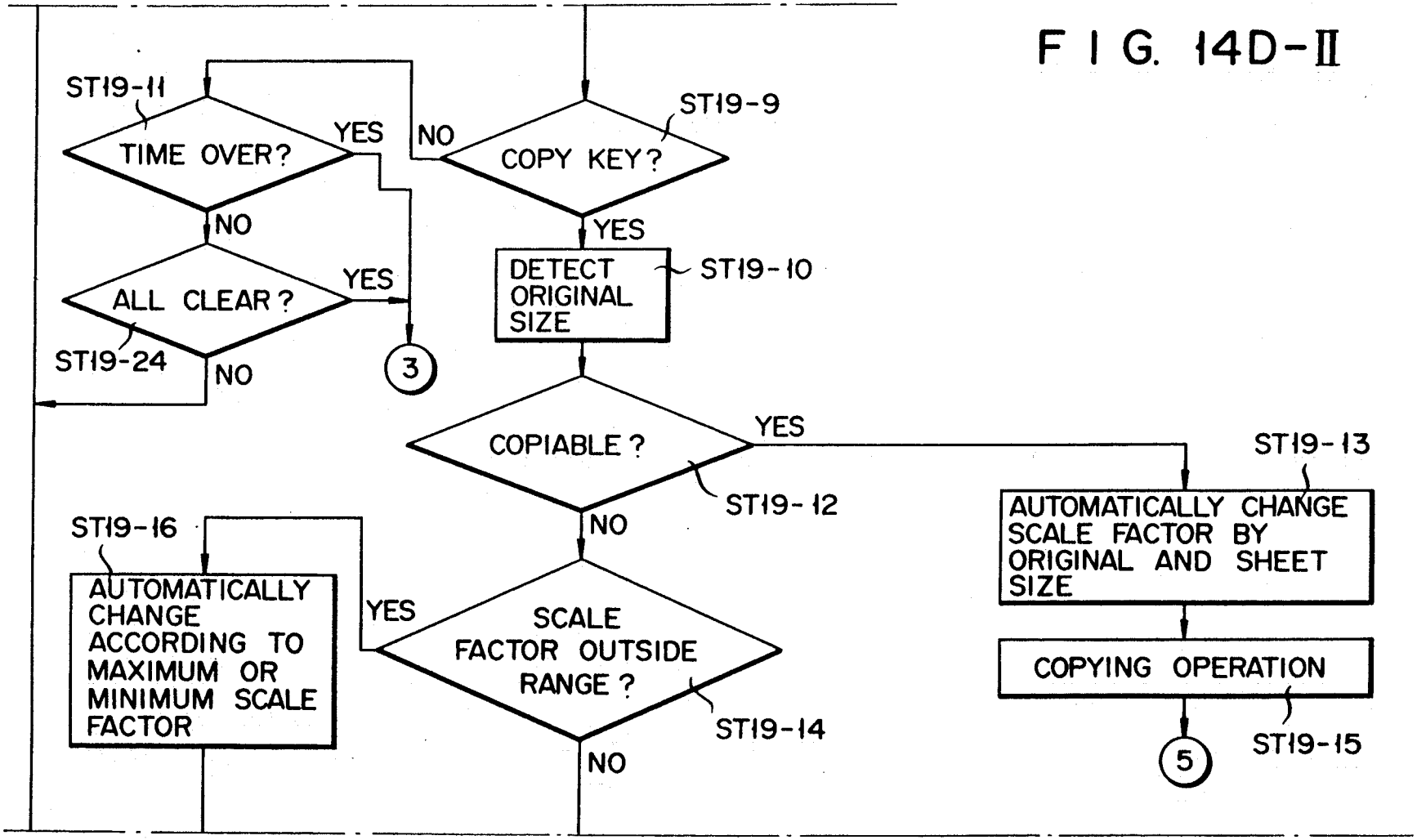

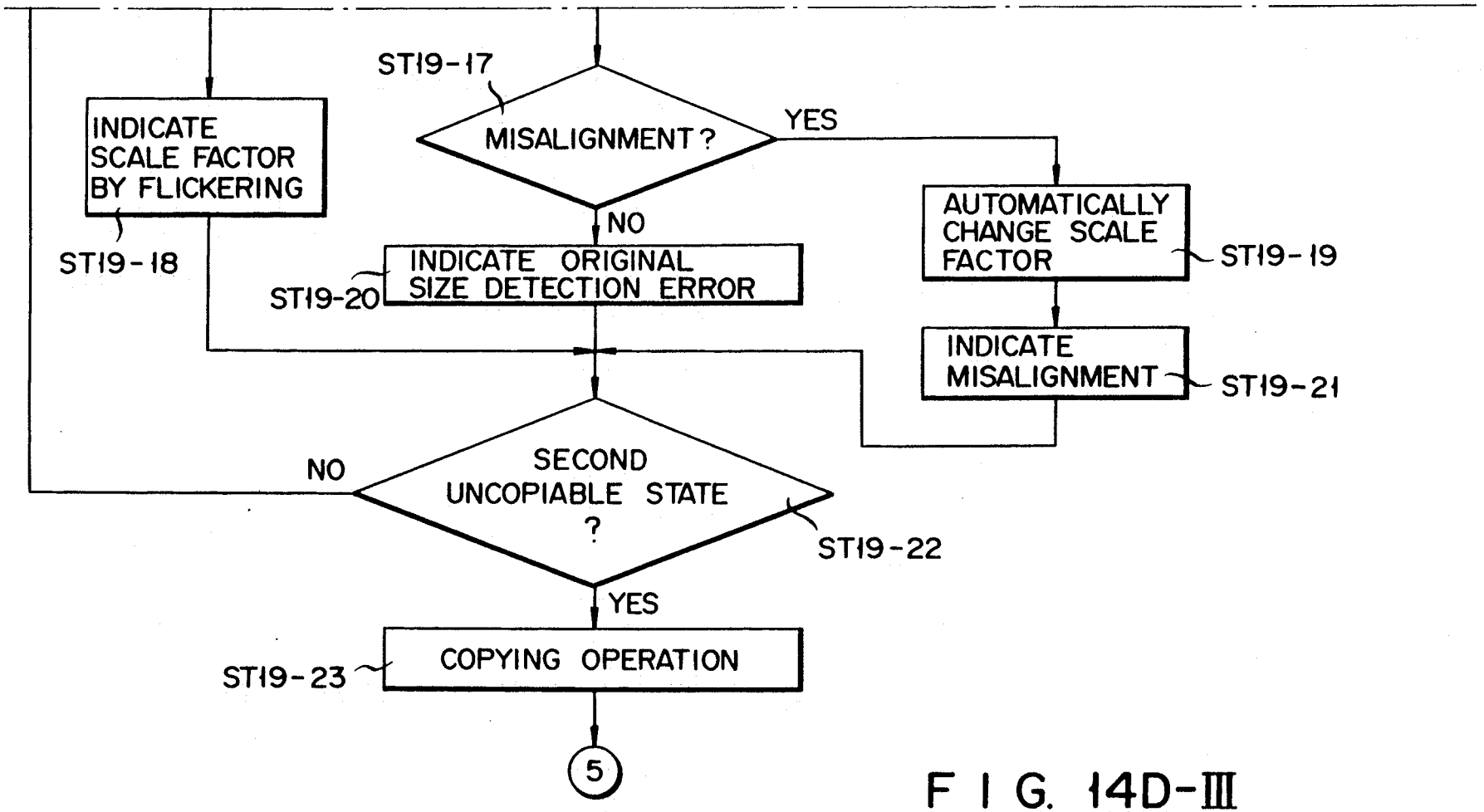
FIG. 14D-III

IMAGE FORMING APPARATUS HAVING PAPER SIZE DETECTING MEANS

BACKGROUND OF THE INVENTION

1. Field of the Invention

The present invention relates to an image forming apparatus, such as an electronic copying machine, having an automatic paper selecting function.

2. Description of the Related Art

In effecting same-size copying, for example, by means of an electronic copying machine, an operator must select paper sheets which correspond to the size of the original used. When copying a plurality of originals of different sizes, such sheet selection is troublesome.

Accordingly, an improved copying machine with an automatic paper selecting function has been developed. In this machine, the size of an original is read, and a paper sheet corresponding to the original size is automatically selected for image formation thereon. The automatic paper selecting function of the copying machine is a function which automatically selects a sheet of the same size as the original, so that a same-size image of the original can be formed on the sheet.

The conventional copying machine of this type does not, however, have a function for informing the operator of the size of the sheets set therein. If the size of the set sheets does not agree with the original size, therefore, the operator must manually reselect sheets of a size adapted for same-size copying of the whole original image, restock with sheets of the original size, or change the copy scale factor to effect enlarged- or reduced-scale copying, after giving a command for starting the copying operation.

SUMMARY OF THE INVENTION

An object of the present invention is to provide an image forming apparatus in which the sizes of transfer media set therein can be identified at a glance, so that the feasibility of an image forming operation using a function of automatic paper selection can be easily determined before a command for start of the operation is given.

According to one aspect of the present invention, there is provided an image forming apparatus which comprises reading means for reading the size of an original; container means for holding sheets of a plurality of types having different sizes; display means for indicating the sizes of the sheets contained in the container means; selecting means for automatically selecting sheets corresponding to an original size, among other sheets contained in the container means, on the basis of the result of a reading by the reading means; and control means for controlling the display means so that the display means indicates the sizes of all the sheets contained in the container means before the start of an image forming operation, and indicates only the size of the selected sheets after the start of the image forming operation.

BRIEF DESCRIPTION OF THE DRAWINGS

FIG. 12 is a diagram logically showing discrimination data used for original size detection of the original detector shown in FIG. 8;

FIGS. 14A-I, 14A-II, 14B, 14C-I, 14C-II, 14C-III, 14D-I, 14D-II, and 14D-III are flow charts for illustrating the copying operation o the copying machine shown in FIG. 1.

DETAILED DESCRIPTION OF THE PREFERRED EMBODIMENTS

An embodiment of the present invention will now be described in detail with reference to the accompanying drawings.

Figure 1:
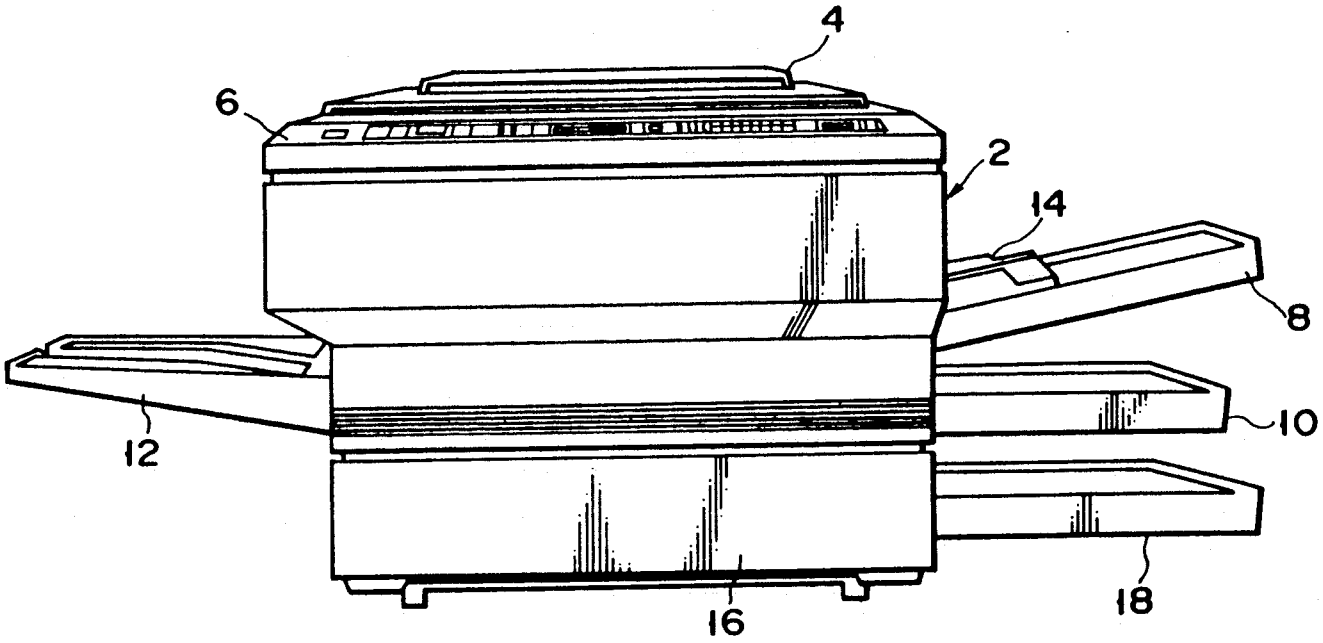
FIG. 1 shows an outline of an electronic copying machine as an image forming apparatus according to the present invention.

FIG. 1 shows an electronic copying machine as an image forming apparatus according to the present invention. In FIG. 1, numeral 2 designates the housing of the copying machine. Swingable original cover 4 is provided on the top of housing 2. It serves to cover an original set on an original table (to be discussed further later). Control panel 6 is located on the front side of the top surface of housing 2. Upper and lower sheet cassettes 8 and 10 are attached to the right-hand side portion of housing 2, while receiving tray 12 is attached to the left-hand side portion of the housing. Lower cassette 10 is located below upper cassette 8. Sheet-bypass guide 14 is disposed on the top of cassette 8. Housing 2 is mounted on sheet feeding unit 16, which can be used as an option. Third sheet cassette 18 is attached to the right-hand side portion of feeding unit 16.

Figure 2:
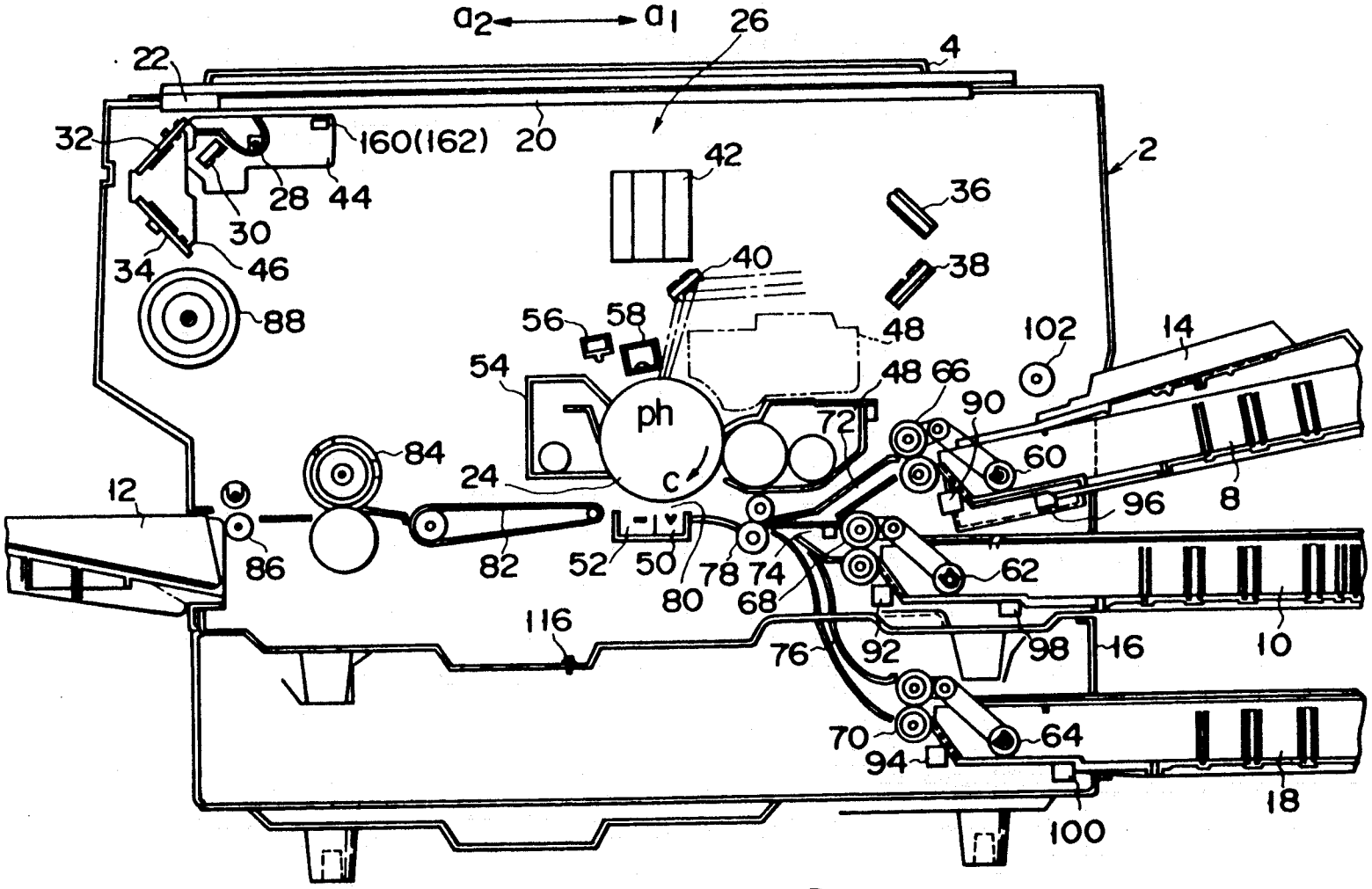
FIG. 2 is a sectional view schematically showing the copying machine shown in FIG. 1.

As shown in FIG. 2, original table 20 (made of transparent glass) for supporting the original is fixed on the top surface of housing 2. Fixed scale 22, which serves as a setting reference for the original, is provided on original table 20. Photosensitive drum 24, which is rotated in the direction of arrow c, is disposed substantially in the center of the inside space of housing 2. Exposure unit 26 is located between drum 24 and table 20. The exposure unit 26 includes exposure lamp 28, first to sixth mirrors 30, 32, 34, 36, 38 and 40, and lens block 42 for the variable scale factor. Lamp 28 is used to illuminate the original on original table 20. The mirrors serve to guide reflected light from the original onto drum 24, and lens block 42 serves to focus the reflected light on drum 24. Lamp 28 and first mirror 30 are supported by first carriage 44, while second and third mirrors 32 and 34 are supported by second carriage 46. As lamp 28 and first to third mirrors 30, 32 and 34 are reciprocated in the directions of arrows $a_1$ and $a_2$, along the underside of original table 20, the original on the table is exposed for scanning. In this case, second and third mirrors 32 and 34 are moved at half the moving speed of first mirror 30 so that the length of an optical path from the original to photosensitive drum 24 is maintained. The reflected light from the original illuminated by means of lamp 28 is reflected successively by first to third mirrors 30, 32 and 34, and is then transmitted through lens block 42. Further, the light is reflected by fourth to sixth mirrors 36, 38 and 40 to be projected on drum 24. Thus, an image of the original is focused on the surface of drum 24.

Photosensitive drum 24 is surrounded by developing device 48, transfer charger 50, separation charger 52, cleaner 54, discharge lamp 56, and main charger 58, which are arranged successively in the rotating direction of drum 24, starting from focusing position ph of exposure unit 26.

Photosensitive drum 24 is rotated in the direction of arrow c of FIG. 2. First, the surface of drum 24 is charged by main charger 58. Thereafter, the reflected light from the original is guided to exposure region ph on drum 24 by exposure unit 26, so that an electrostatic latent image is formed on the surface of drum 24. As toner adheres to the latent image by means of developing device 48, the latent image is generated. Thus, a toner image is formed on photosensitive drum 24. Developing device 48 is removably attached to copying machine housing 2. Code information (not shown), indicative of the color of the toner in developing device 48, is provided on a lateral face of developing device 48. When developing device 48 is set in housing 2, the code information is read by means of a sensor (not shown) attached to the housing. Thus, the toner color is automatically identified.

Paper sheets are picked up one by one from upper sheet cassette 8, lower sheet cassette 10, or third sheet cassette 18 by means of pickup roller 60, 62 or 64 and a pair of feed rollers 66, 68 or 70. Each delivered sheet is guided through sheet guide path 72, 74 or 76 to a pair of aligning rollers 78, whereupon it is transported thereby to transfer region 80.

The sheet delivered to transfer region 80 is brought into close contact with the surface of photosensitive drum 24. The toner on drum 24 is transferred to the sheet by the action of transfer charger 50. Then, the sheet is electrostatically separated from drum 24 by the action of separation charger 52, and is transported to a pair of fixing rollers 84 by means of conveyor belt 82. As the sheet passes rollers 84, the toner image is fixed on the sheet. After the fixing operation, the sheet is discharged onto tray 12 outside housing 2 by means of a pair of exit rollers 86.

Those toner particles remaining on photosensitive drum 24, without having been transferred to the sheet by the action of transfer charger 50, are removed by means of cleaner 54. Then, a residual image on the surface of drum 24 is erased by the action of discharge lamp 56. Thereupon, drum 24 is restored to its initial state. Numeral 88 denotes a cooling fan for preventing the temperature inside housing 2 from rising too high.

Any of sheet cassettes 8, 10 and 18 can be alternatively selected by operating control panel 6, which will be described in detail later. The sizes of the sheets stored in cassettes 8, 10 and 18 are detected by means of cassette size detecting switches 90, 92 and 94, respectively. Switches 90, 92 and 94 are each composed of a plurality of microswitches which are adapted to be turned on and off when the apparatus is loaded with cassettes of different sizes. The storage of the sheets in cassettes 8, 10 and 18 is detected by means of sheet detectors 96, 98 and 100, respectively. Detectors 96, 98 and 100 are each composed of, for example, a reflector-type optical sensor.

A paper sheet manually fed through sheet-bypass guide 14 is guided to feed rollers 66 by pickup roller 102, and is then transported in the same manner as each sheet fed from upper sheet cassette 8.

Figure 3:
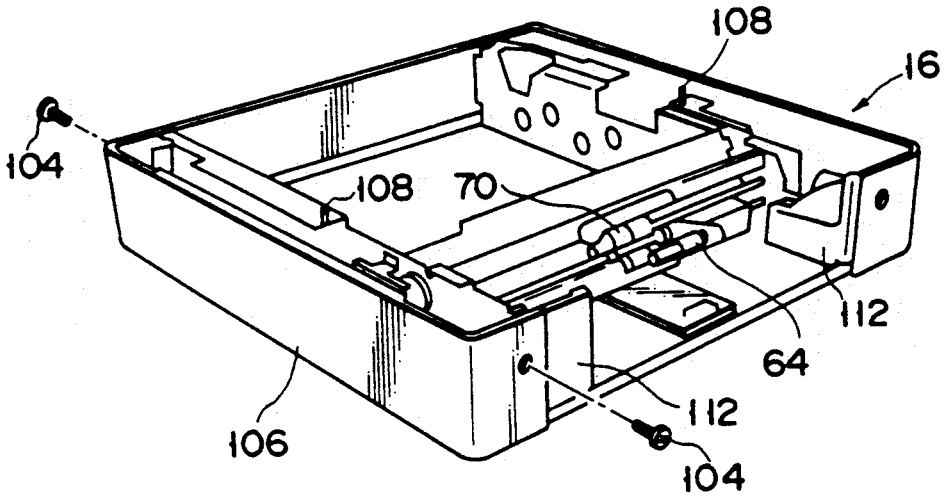
FIG. 3 is a perspective view of a sheet feeding unit used in the copying machine shown in FIG. 1.
Figure 4:
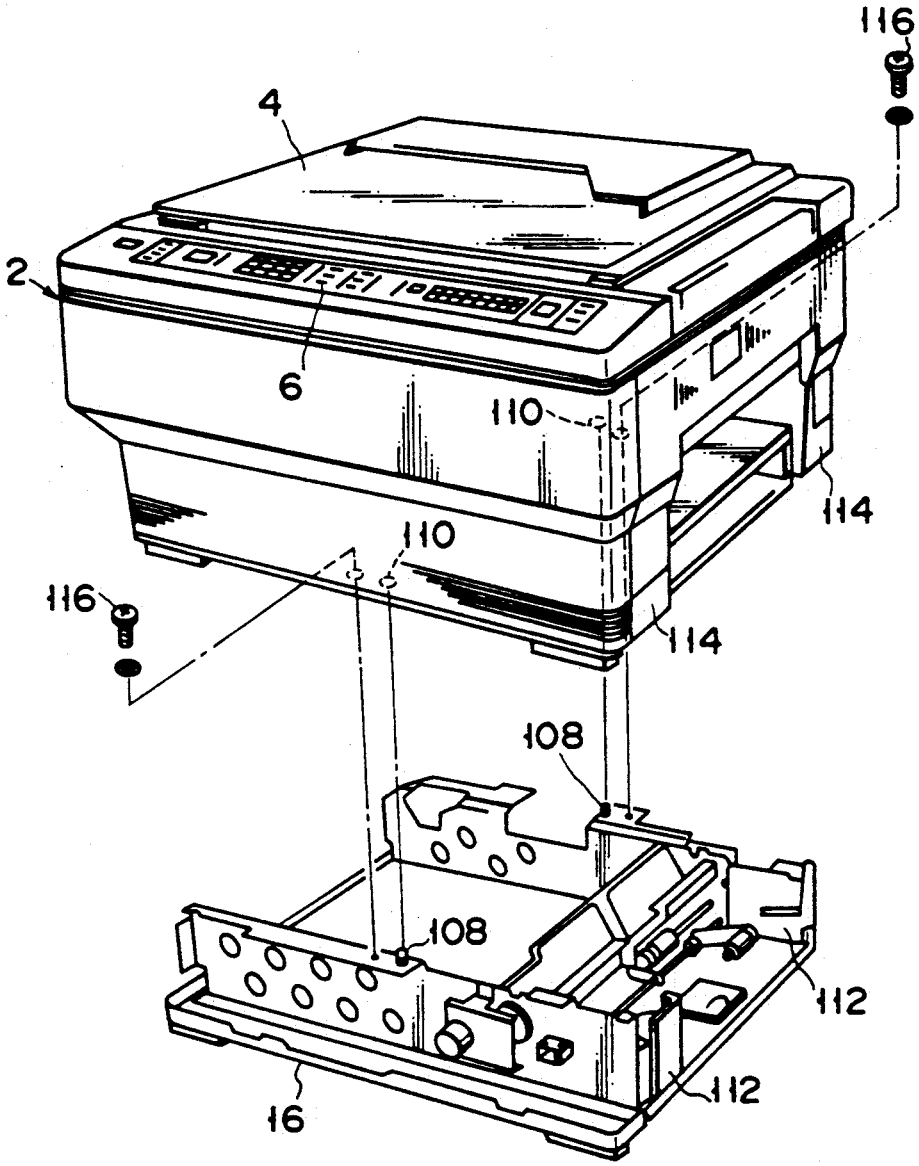
FIG. 4 is a perspective view for illustrating an operation for attaching the sheet feeding unit shown in FIG. 3 to a housing of the copying machine.

As shown in FIG. 3, sheet feeding unit 16 includes cover 106 which is fixed by means of a plurality of screws 104. In mounting feeding unit 16 on copying machine housing 2, engaging projection 108 and guide cassettes 112 of unit 16 are first aligned with engaging hole 110 and guide cassettes 114 of housing 2, respectively, as shown in FIG. 4. Then, feeding unit 16 is fixed to housing 2 by means of screws 116.

Figure 5:
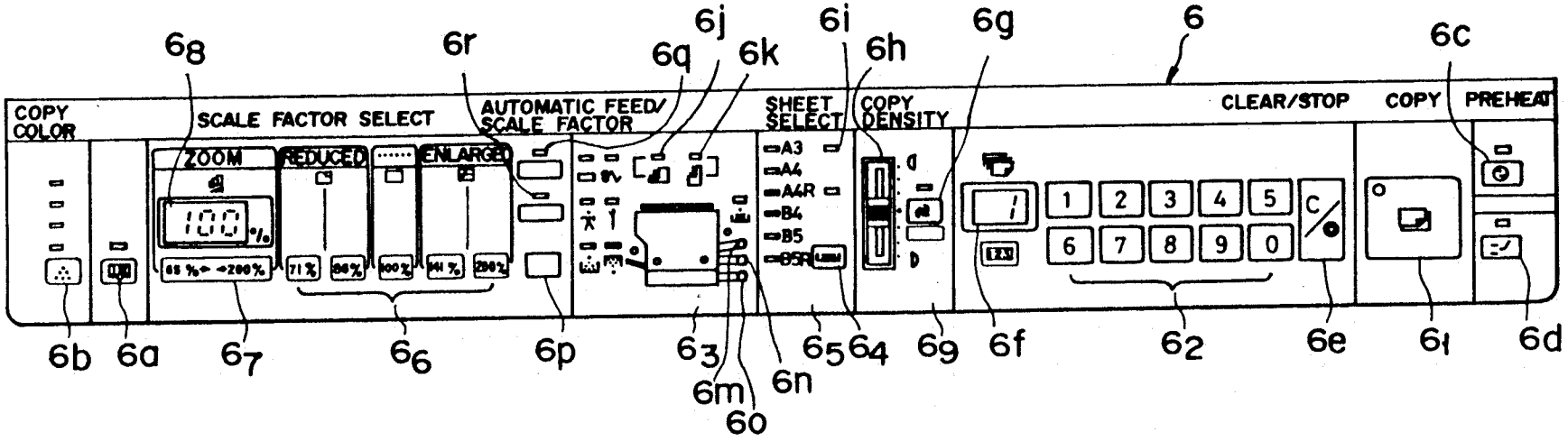
FIG. 5 is a plan view of a control panel of the copying machine shown in FIG. 1.

FIG. 5 shows control panel 6. Numeral $6_1$ designates a copy key; $6_2$, numeral keys; $6_3$, a display section; $6_4$, a cassette select key; $6_5$, a cassette display section; $6_6$, scale factor setting keys; $6_7$, a zoom key; $6_8$, a scale factor display section; and $6_9$, a density setting section. Copy key $6_1$ is used to give a command for the start of copying operation. Numeral keys $6_2$ are operated for setting the number of copies (registered number). Display section 63 indicates the operating states of various parts as well as a sheet jam. Select key $6_4$ is operated for the selection between upper, lower, and third sheet cassettes 8, 10 and 18. Display section $6_5$ indicates the size of sheets in the selected cassette. Setting keys $6_6$ are operated for setting the scale factor. Zoom key $6_7$ is operated for stepless adjustment of the scale factor. Display section $6_8$ indicates the set scale factor. Setting section $6_9$ is used to set the copy density.

Further, numeral *6a* designates a consecutive-page copy key for setting a consecutive-page copy function; *6b*, a color selector key for color copying; *6c*, a preheat key for establishing and canceling a preheated state; and *6d*, an interrupt key to be operated for interruptive copying in the middle of continuous copying. Numeral *6e* designates a clear key. When it is operated once, key *6e* functions as a clear/stop key for giving a command for correction of the number of copies or termination of the copying operation. When it is operated twice, key *6e* functions as an all-clear key for canceling set copying conditions, such as the copy number, copy scale factor, etc. Numeral *6f* designates a registered number display section for indicating the copy number and the like; *6g*, an automatic exposure key in density setting section $6_g$ for automatically setting the copy density; and *6h*, an exposure setting control for manually setting the copy density. Cassette display section $6_5$ includes manual feed indicator *6i* for indicating that paper sheets are set on sheet-bypass guide 14. Display section $6_3$ includes indicators *6j* and *6k* for indicating the original setting direction. Numerals *6m*, *6n* and *6o* designate indicators for indicating the absence of sheets in sheet cassettes 8, 10 and 18, respectively.

Numeral *6p* designates an automatic key (setting means) for shifting between an automatic paper selection mode (APS mode), an automatic magnification selection mode (AMS mode), and a manual mode. In the APS mode, the size of the original is read, and a sheet of a size corresponding to the original size is automatically selected. In the AMS mode, the copy scale factor is automatically selected in accordance with the original size and the sheet size. When key 6p is operated, the operation mode is switched in the order of the APS, AMS, manual, and APS modes. Numerals 6q and 6r designate indicators for indicating the establishment of the APS and AMS modes, respectively.

Figure 6:
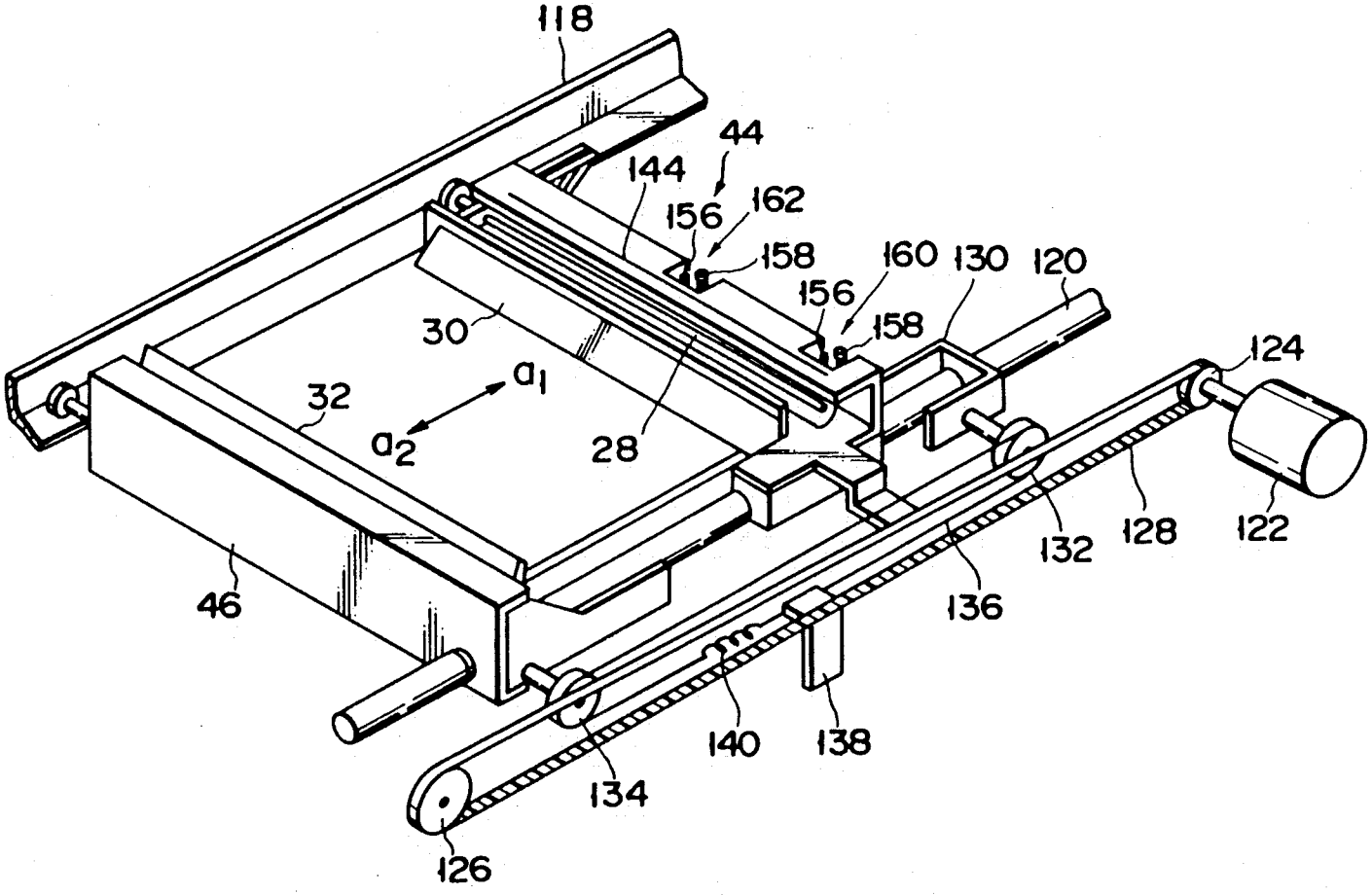
FIG. 6 is a perspective view schematically showing a drive mechanism for an optical system of the copying machine shown in FIG. 1.

FIG. 6 shows a drive mechanism for reciprocating first and second carriages 44 and 46 of exposure unit 26. As mentioned before, first mirror 30 and exposure lamp 28 are supported by first carriage 44, while second and third mirrors 32 and 34 are supported by second carriage 46. Carriages 44 and 46, which are guided by guide rail 118 and guide shaft 120, can move parallel to each other, in the directions of arrows $a_1$ and $a_2$. Numeral 122 designates a four-phase pulse motor. Pulley 124 is attached to the rotating shaft of motor 122, which is situated near one end of shaft 120. Idle pulley 126 is located near the other end of shaft 120. Endless belt 128 is passed around and between pulleys 124 and 126. One end of first carriage 44 is fixed to the middle portion of belt 128.

Second carriage 46 includes guide portion 130, which is provided with two pulleys 132 and 134 rotatably arranged at a distance in the axial direction of guide shaft 120. Wire 136 is passed around and between pulleys 132 and 134, with one end attached to fixed portion 138, while the other end is connected to one end of coil spring 140. The other end of spring 140 is also fixed to portion 138. The middle portion of wire 136 is fixed to one end of first carriage 44. When pulse motor 122 is rotated, belt 128 rotates to move carriage 44. Accompanying this, second carriage 46 is also moved. Since pulleys 132 and 134 function as running blocks, carriage 46 is moved in the same direction as and at half the speed of carriage 44. The moving direction of each carriage can be controlled by changing the rotating direction of pulse motor 122.

Figure 7:
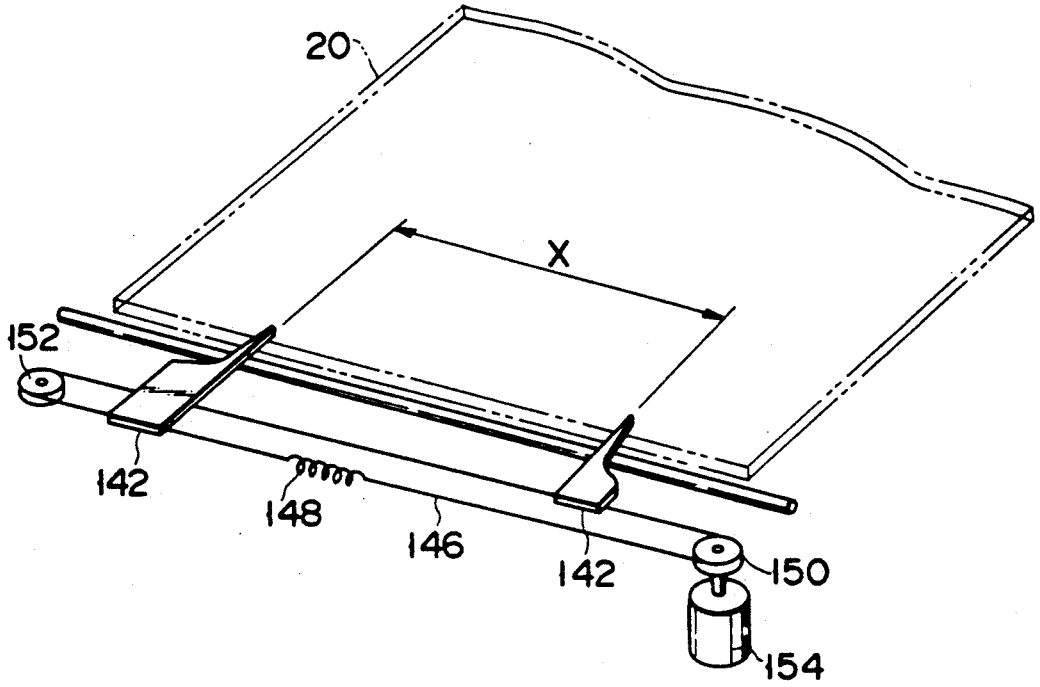
FIG. 7 is a perspective view schematically showing a drive mechanism for indexes of the copying machine shown in FIG. 1.

As shown in FIG. 7, a copyable range corresponding to a specified paper sheet is indicated on original table 20. If the sheet size designated by means of cassette select key $6_4$ and the copy scale factor designated by means of scale factor setting key $6_6$ or zoom key $6_7$ are (Px, Py) and K, respectively, copyable range (x, y) is given by $x=Px/K$ and $y=Py/K$. The x-direction length of range (x, y) is indicated by the distance between a pair of indexes 142 which are arranged on the underside of original table 20. The y-direction length of range (x, y) is indicated by the distance between fixed scale 22 and scale 144 (see FIG. 6), which is located on the upper surface portion of first carriage 44.

As shown in FIG. 7, indexes 142 are fixed to wire 146, which is passed around and between a pair of pulleys 150 and 152. Wire 146 is an endless wire looped by means of spring 148. Pulley 150 is rotated by means of motor 154. The distance between indexes 142 can be changed by driving motor 154 in accordance with the x-direction length of the copyable range obtained as aforesaid.

As motor 122 is driven in accordance with the sheet size and the copy scale factor, first carriage 44 is moved to a predetermined home position corresponding to the scale factor.

Figure 8:
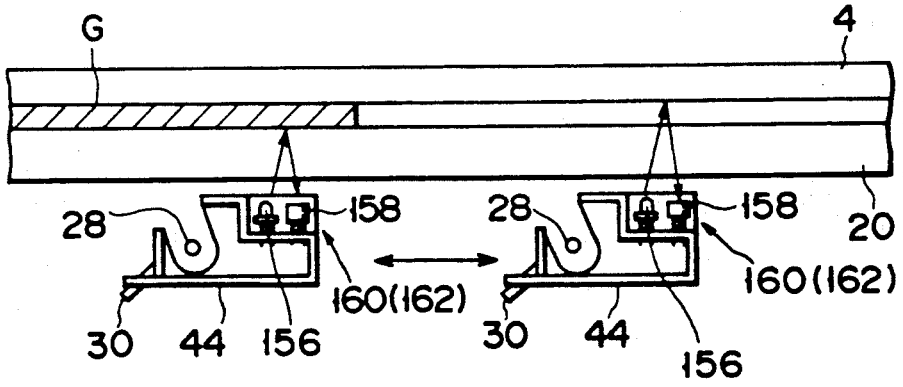
FIG. 8 is a sectional view for illustrating an original detector of the copying machine shown in FIG. 1.

As shown in FIGS. 6 and 8, first carriage 44 is provided with original detectors 160 and 162, which are each composed of light emitting element 156, such as a light emitting diode, and light sensing element 158, such as a photosensor. When copy key $6_1$ is operated, detectors 160 and 162 detect the presence of the original at the home position before scanning the original. Based on the result of this detection, the direction of the movement of first carriage 44 from the home position is determined. The original detectors detect the presence of the original as carriage 44 moves from the home position.

As shown in FIG. 8, reflected light beams from original (white original) G and original cover 4, irradiated by means of light emitting elements 156, are transmitted through original table 20, and then received by light sensing elements 158, to be converted thereby into electrical signals corresponding individually to the respective reflection factors of original G and cover 4. These signals are supplied to a main processor group, which will be described later, and are used for original size detection thereby.

The whole or part of the inside portion of original cover 4 is tinged with a color highly sensitive to photosensitive drum 24. If drum 24 is formed from a selenium-based photoconductor, for example, the inside portion of cover 4 is tinged with pale blue. This is because a blue image cannot be easily transferred to the selenium-based photoconductor drum, that is, blue light, which is highly sensitive to a drum of this type, can not form a latent image. When using a fluorescent lamp as exposure lamp 28, therefore, pale blue is regarded as substantially equal to white. Thus, a copy image (copy output) is not influenced by the color of original cover 4.

Figure 9:
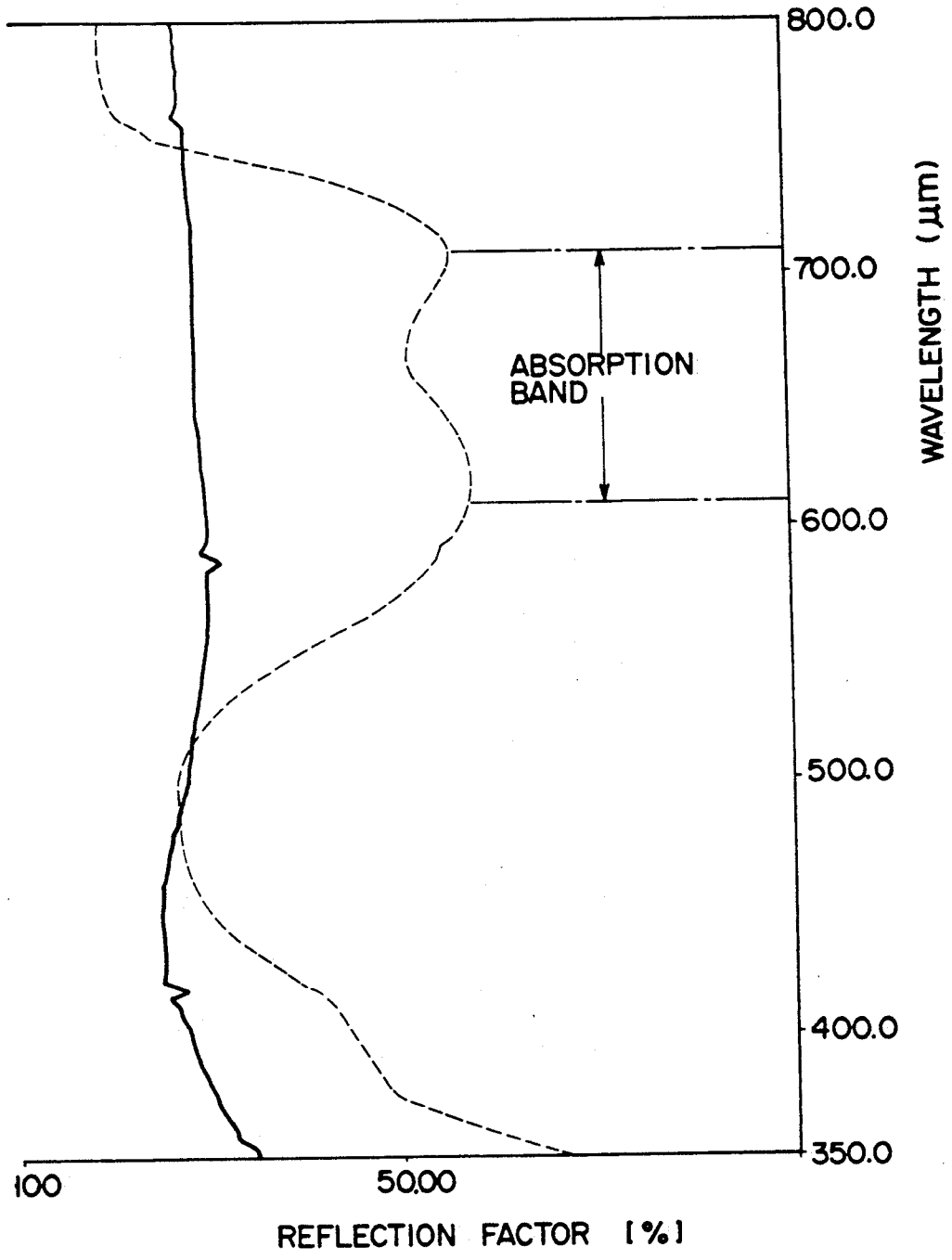
FIG. 9 shows characteristic curves indicative of the spectral characteristics of white and pale blue, with respect to the reflection factor.

Each light emitting element 156 emits a light beam of a wavelength band whose reflection factor for the color of original cover 4 is low. Pale blue has such a spectral characteristic, with respect to the reflection factor, as is indicated by the broken line in FIG. 9. As seen from FIG. 9, the reflection factor of pale blue is about half that of white (indicated by a solid line), with respect to a wavelength band of about 600.0 ρm to 700.0 μm, i.e., the band for red or yellowish brown. Thus, if photosensitive drum 24 is formed of a selenium-based photoconductor, the inside portion of original cover 4 is tinged with pale blue, and the wavelength of the light beam from light emitting element 156 is adjusted to red or yellowish brown which corresponds to the absorption band for pale blue, in the spectral characteristic with respect to the reflection factor. By doing this, original G can be easily discriminated from original cover 4 by a difference in reflection factor, by means of a low-priced photosensor for visible light, without influencing the copy image.

Figure 10:
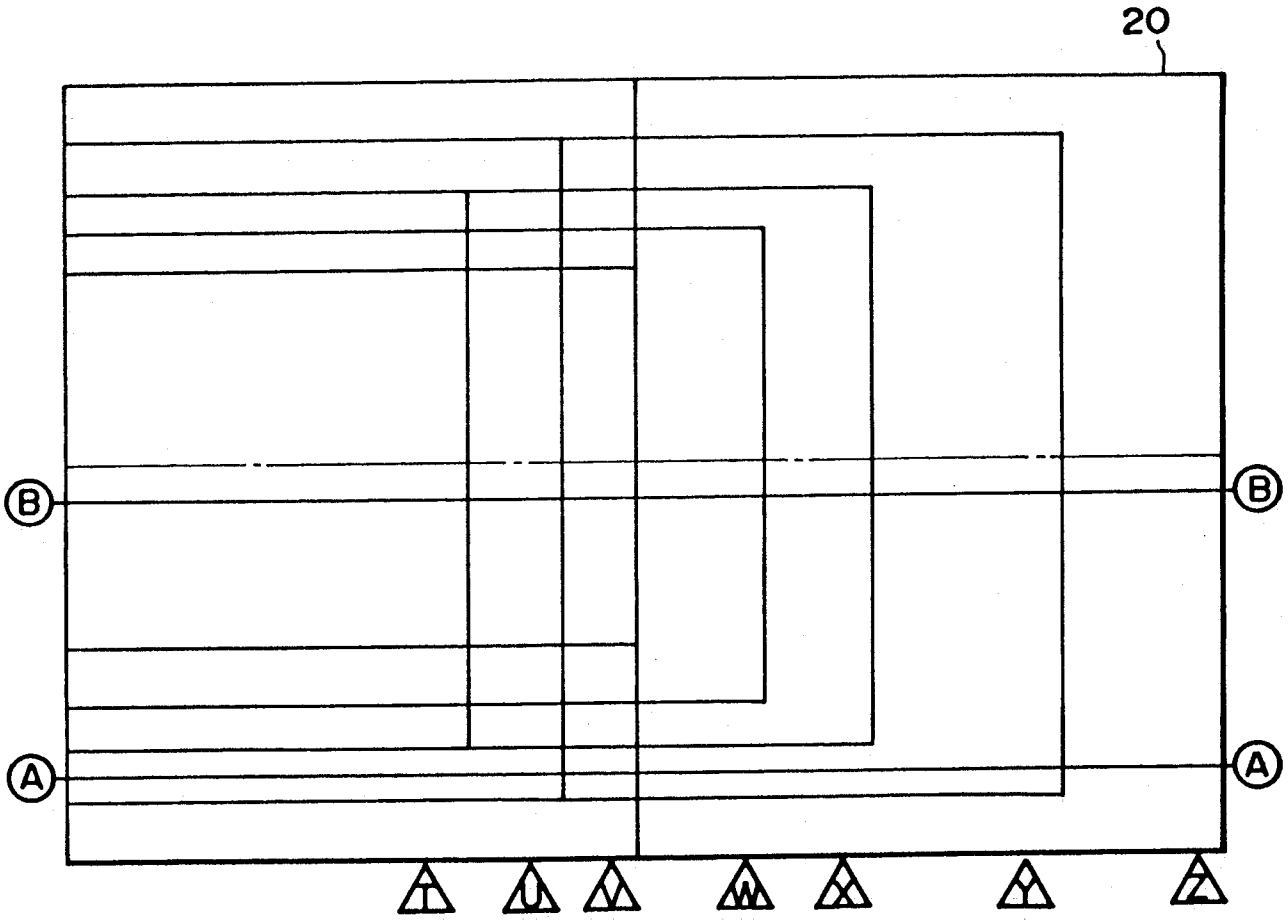
FIG. 10 is a diagram for illustrating the detecting operation of the original detector shown in FIG. 8.

As shown in FIG. 10, original detectors 160 and 162 are situated so as to be able to scan original table 20 along straight lines A-A and B-B, respectively. For example, the length of the original perpendicular to the scanning direction is detected by the output of detector 160, and the original length in the scanning direction is detected by the logical sum of the respective outputs of detectors 160 and 162. Thus, wrong detection is prevented despite the existence of a black image in the scanning position. Originals of sizes "A5" to "A3" can be set on original table 20. Original setting positions are predetermined so that any of the originals can be set with the center line (indicated by a dashed line in FIG. 10) of table 20 as a base line.

Original detectors 160 and 162 detect the original at detecting positions designated by symbols T, U, V, W, X, Y and Z in FIG. 10. Thus, during the original size detection, first carriage 44 is situated at any of the detecting positions. More specifically, the output levels of light sensing elements 158 of detectors 160 and 162 are determined in synchronism with the arrival of carriage 44 at positions T to Z.

Figure 11:
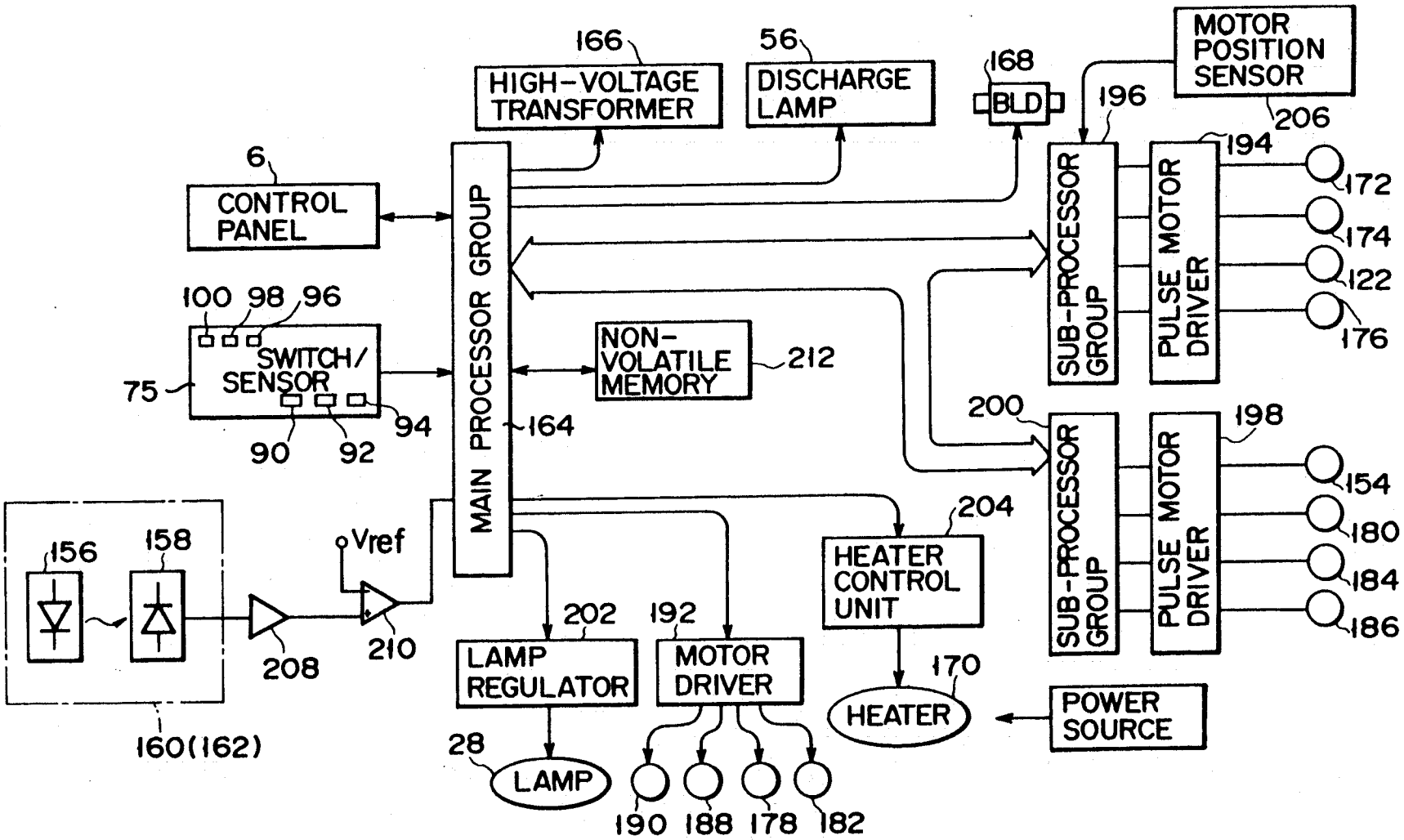
FIG. 11 is a diagram showing a control circuit of the copying machine shown in FIG. 1.

FIG. 11 shows the principal part of a control circuit. Main processor group 164 detects input signals from control panel 6 and several input devices, which include various switches and sensors, such as cassette size detecting switches 90, 92 and 94 and paper detectors 96, 98 and 100. Then, the main processor group controls high-voltage transformer 166 for driving the various chargers, discharge lamp 56, blade solenoid 168 of cleaner 54, heater 170 of fixing rollers 84, exposure lamp 28, motors 122 and 154, etc., thus causing these elements to execute the aforementioned copying operation.

When the APS (automatic paper selection) mode is established, all the available sheet sizes for the copying machine are indicated by means of indicators of cassette display section 65 for the individual sheet sizes (a maximum of three indicators glow, in this embodiment), before the start of the copying operation. When the copying operation is started, the cassette which stores the sheets of the size corresponding to the original size detected by original detectors 160 and 162 is automatically selected. At the same time, the selected cassette is indicated by means of its corresponding indicator of cassette display section $6_5$.

Numeral 172 designates a lens motor; 174, a mirror motor; 122, a scanning motor; 176, a shutter motor; 178, a developing motor; 180, a drum motor; 182, a fixing motor; 184, a paper supply motor; 186, a sheet feed motor; and 188, a fan motor. Lens motor 172 is used to shift the position of lens block 42 to change the scale factor. Mirror motor 174 is used to change the distance (optical path length) from first mirror 30 to second and third mirrors 32 and 34, for the change of the scale factor. Scanning motor 122 is used to move first carriage 44. Shutter motor 176 is used to move a shutter (not shown) for adjusting the width of charging photosensitive drum 24 by means of main charger 58 at the time of scale factor change. Developing motor 178 and drum motor 180 are used to drive a developing roller and other components of developing device 48 and drum 24, respectively. Fixing motor 182 is used to drive sheet guide paths 72, 74 and 76, fixing rollers 84, and exit rollers 86. Paper supply motor 184 serves to drive pickup rollers 60, 62 and 64 and feed rollers 66, 68 and 70. Sheet feed motor 186 serves to drive aligning rollers 78. Fan motor 188 is used to drive cooling fan 88. Motors 178, 182 and 188, among motors 172, 174, 122, 176, 178, 182, 188 and 154, and toner motor 190, which is used to supply the toner to developing device 48, are controlled by main processor group 164 through motor driver 192. Motors 172, 174, 122 and 176 are controlled by first sub-processor group 196 through pulse motor driver 194. Motors 154, 180, 184 and 186 are controlled by second subprocessor group 200 through pulse motor driver 198.

Exposure lamp 28 is controlled by main processor group 164 with the aid of lamp regulator 202. Heater 170 is controlled by group 164 with the aid of heater control unit 204.

Drive/stop commands for the individual motors are delivered from main processor group 164 to first and second sub-processor groups 196 and 200. Status signals, indicative of the drive/stop state of the motors, and other signals are delivered from groups 196 and 200 to group 164. First sub-processor group 196 is supplied with position information from position sensor 206 for detecting the respective initial positions of motors 172, 174, 122 and 176. Sub-processor groups 196 and 200 are composed of, e.g., microcomputers and programmable interval timers, which count reference clock pulses in accordance with set points supplied from the microcomputers, thereby controlling the phase shift interval time of the pulse motor.

The count values of the reference clock pulses are supplied to main processor 164 through first and second sub-processor groups 196 and 200.

The outputs of original detectors 160 and 162 are supplied successively through amplifier 208 and comparator 210 to main processor group 164. Amplifier 208 converts the outputs of light sensing elements 158 into voltage signals. Comparator 210 compares the outputs of detectors 160 and 162 to a reference voltage (Vref), thereby correcting fluctuations of the output levels of sensing elements 158 attributable to variations of the sensitivity of the sensing elements or temperature changes.

Main processor group 164 is provided with a RAM (random access memory) and a ROM (read-only memory). The RAM contains position data for detecting the position (detecting position) of first carriage 44 in accordance with count data indicative of the count number of pulses supplied from first sub-processor group 196 to motor 122. The ROM contains discrimination data for detecting the original size in accordance with the output levels of light sensing elements 158 (from original detectors 160 and 162) when carriage 44 is situated at each detecting position indicated by the position data.

Main processor group 164 is further provided with nonvolatile memory ($E^2$PROM) 212. Memory 212 contains, for example, data for determining the priority of selection between the APS mode and the manual mode, the priority of cassette selection for the set paper sheets, and the priority of selection between an automatic start mode and a manual start mode. In the automatic start mode, the copying operation is automatically started by manual sheet feed. In the manual start mode, the copying operation is started by operating copy key $6_1$. The data for determining these selection priorities can be changed by a serviceman establishing an AJ (adjust) mode.

FIG. 12 logically shows discrimination data used for the detection of the size of original G in main processor group 164. In FIG. 12, the output levels (at the individual detecting positions) of light sensing elements 158 of original detectors 160 and 162, scanning along straight lines A—A and B—B, respectively, on original table 20 shown in FIG. 10, are indicated by circles and crosses. Each circle represents a case in which the output level corresponding to the reflected light beam from original G, i.e., the presence of the original, is detected. Each cross indicates a case in which the output level corresponding to the reflected light beam from original cover 4, i.e., the presence of the cover, is detected.

The following is a description of the operation for automatically detecting the size of original G.

First, the presence of original G in the home position corresponding to, e.g., first carriage 44 is detected by means of original detectors 160 and 162. When the presence of original G in the home position is detected, pulse motor 122 is controlled by means of first subprocessor group 196, in accordance with the result of the detection, so that first carriage 44 starts to be moved. If original G is detected at the home position, carriage 44 is moved in the direction of arrow $a_1$ of FIG. 2. If not, carriage 44 is moved in the direction of arrow $a_2$.

Figure 13A:
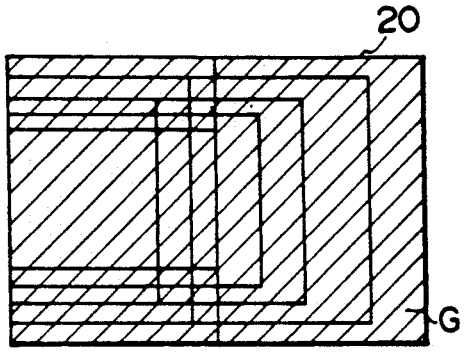
FIGS. 13A to 13H are diagrams for illustrating the original size detecting operation of the original detector shown in FIG. 8.

During the movement of first carriage 44, original detectors 160 and 162 are operated, and the reflected light beam from original G or original cover 4, produced when light emitting elements 156 are turned on, is received by light sensing elements 158. The outputs of sensing elements 158 of detectors 160 and 162, along with the count data indicative of the count number of pulses supplied to motor 122, are delivered to main processor group 164 The main processor group determines the output levels of light sensing elements 158 of detectors 160 and 162 at detecting positions T, U, V, W, X, Y and Z of first carriage 44, which are obtained on the basis of the count data (pulse number) and the position data. The results of such a determination and the discrimination data (shown in FIG. 12) are used to identify the original size If an original G of, for example, size "A3" is set on original table 20, as shown in FIG. 13A, the presence of the original is detected (circle) from the outputs of original detectors 160 and 162 when first carriage 44 is situated at all of detecting positions T to Z. This conclusion can be reached only if original G is of size "A3," as shown in FIG. 12. In this case, original G is identified as an original of size "A3."

Figure 13E:
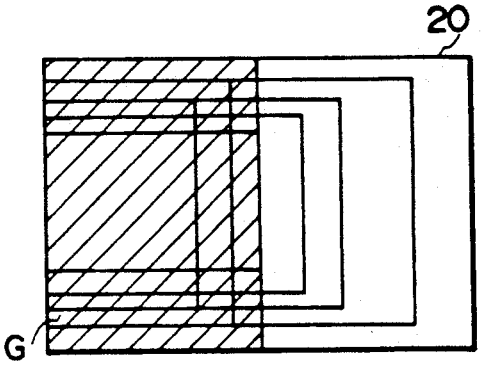
Figure 13B:
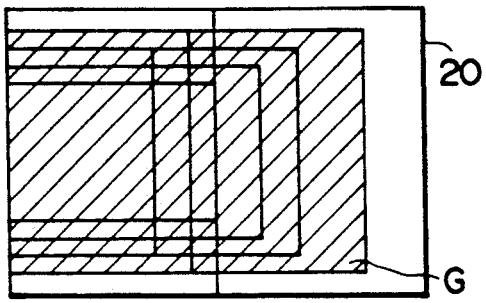
Figure 13F:
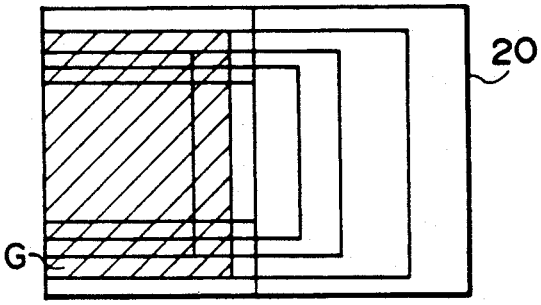
Figure 13C:
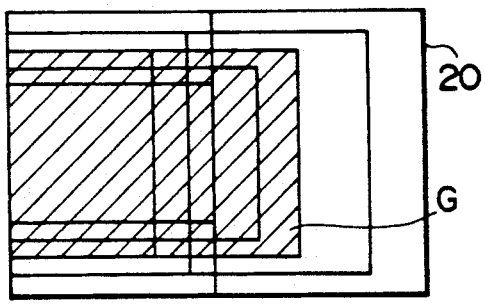
Figure 13G:
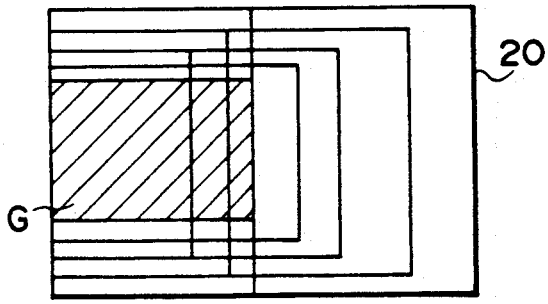
Figure 13D:
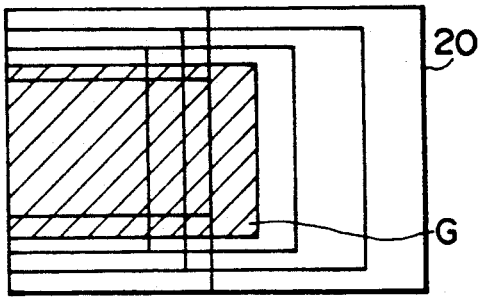

If an original G of size "A4-vertical" is set on original table 20, as shown in FIG. 13E, the presence of the original is detected (circle) from the outputs of original detectors 160 and 162 when first carriage 44 is situated at detecting positions T to V. When carriage 44 is situated detecting positions W to Z, the presence of original cover 4 is detected (cross) from the outputs of the detectors. This conclusion can be reached only if original G is of size "A4-vertical," as shown in FIG. 12. In this case, original G is identified as an original of size "A4-vertical."

Figure 13H:
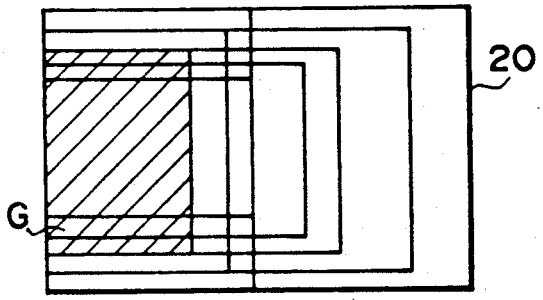

If an original G of size "A5-vertical" is set on original table 20, as shown in FIG. 13H, for example, the presence of the original is detected (circle) from the output of original detector 162 when first carriage 44 is situated at detecting position T. The presence of original cover 4 is detected (cross) from the output of detector 160 when carriage 44 is situated at position T, and from the outputs of detectors 160 and 162 when carriage 44 is situated at al of positions U to Z. This conclusion can be reached only if original G is of size "A5-vertical," as shown in FIG. 12. In this case, original G is identified as an original of size "A5-vertical (nonstandardized)."

FIGS. 13B, 13C, 13D, 13F and 13G show the cases of originals G of sizes "B4," "A4-horizontal (A4-R)," "B5-horizontal (B5-R)," "B5-vertical," and "A5-horizontal (nonstandardized)," respectively. In any of these cases, the size of original G can be accurately detected on the basis of a combination of the position of first carriage 44 and information indicative of the presence of the original, i.e., the outputs of the two light sensing elements 158 (from original detectors 160 and 162) at detecting positions T to Z, as shown in FIG. 12.

Referring now to the flow chart of FIGS. 14A to 14D, the operation of the aforementioned arrangement: will be described.

Figures 1, 14A:
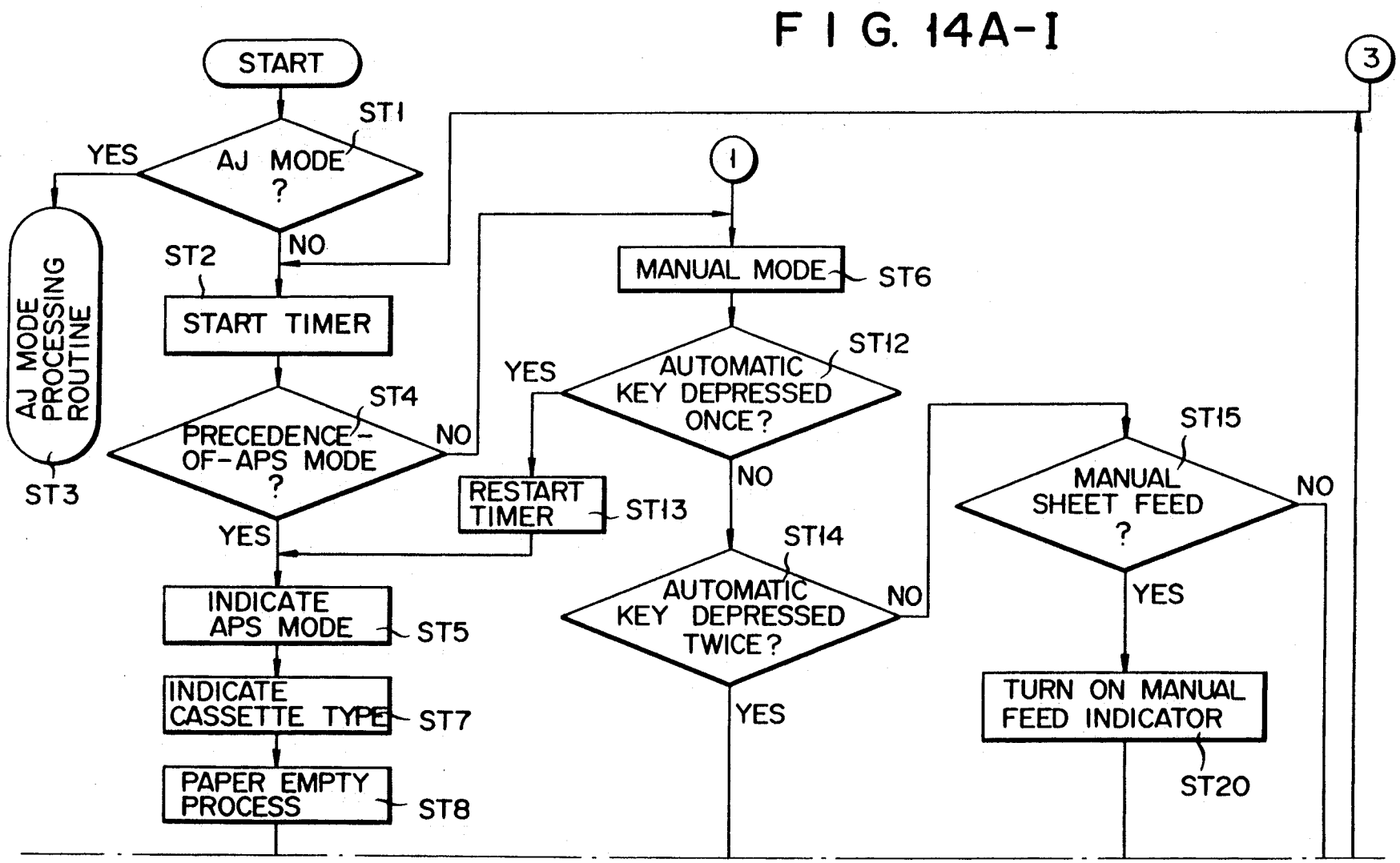

If a power source (not shown) in copying machine housing 2 is turned on, step ST1 of FIG. 14A is executed.

In step ST1, whether a copy mode, in which an original image is copied, or the AJ (adjust) mode, in which the contents of nonvolatile memory 212 are modified, is established. If establishment of the copy mode is detected, the program proceeds to step ST2. If the establishment of the AJ mode is detected, the program proceeds to step ST3.

Figure 14B:
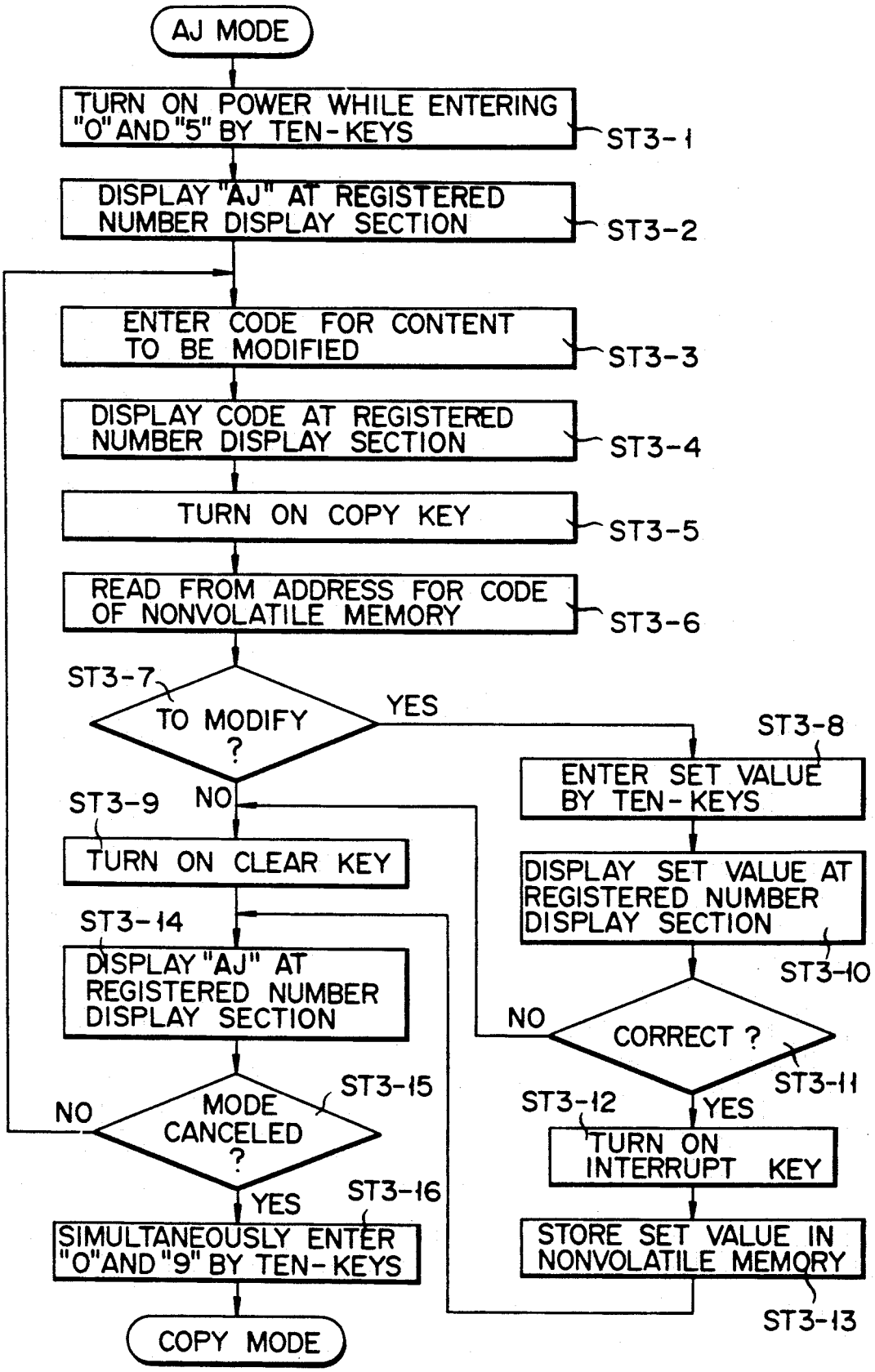

In step ST3, the process routine shown in FIG. 14B is executed. This routine begins with step ST3-1.

In step ST3-1, the power is turned on while simultaneously entering "0" and "5" by means of numeral-keys $6_2$ for example, whereupon the AJ mode is established. Then, the program proceeds to step ST3-2.

In step ST3-2, characters "AJ" are displayed at registered number display section 6*f*. Then, the program proceeds to step ST3-3.

In step ST3-3, a code indicative of the content to be modified is entered by means of numeral-keys $6_2$. Then, the program proceeds to step ST3-4.

In step ST3-4, the above code is displayed at registered number display section 6*f*. Then, the program proceeds to step ST3-5.

In step ST3-5, copy key $6_1$, for example, is turned on. Then, the program proceeds to step ST3-6.

In step ST3-6, data stored in the address of nonvolatile memory 212 which corresponds to the aforesaid code is read out and displayed at registered number display section 6*f*.

In this case, the address of nonvolatile memory 212, which corresponds to, e.g., code "19," is stored with "1 (precedence of APS mode)" or "0 (precedence of manual mode)" as data which indicates the priority of selection between the APS mode and the manual mode. Thus, if copy key $6_1$ is turned on after "19" is entered as the input code, data "0" or "1" is displayed at registered number display section 6*f*. Normally data "1" is set indicative of the precedence of the APS mode.

The address of nonvolatile memory 212 which corresponds to, e.g., code "14," is stored with "0" (precedence of A4-size sheets), "1" (precedence of lower sheet cassette), "2" precedence of third sheet cassette), or "3" (precedence of upper sheet cassette) as data which indicates of cassette selection for the set paper sheets. Thus, if copy key $6_1$ is turned on after "14" is entered as the input code, data "0," "1," "2" or "3" is displayed at display section 6*f*. Normally data "0" is set indicative of the precedence of A4-size sheets.

The address of nonvolatile memory 212 which corresponds to, e.g., code "17," is stored with "0" (precedence of automatic start mode, or "1" (precedence of manual start mode) as data which indicates the priority of selection between the automatic start mode, in which the copying operation is automatically started by manual sheet feed, and the manual start mode, in which the copying operation is started by operating copy key $6_1$. Thus, if copy key $6_1$ is turned on after "17" is entered as the input code, data "0" or "1" is displayed at display section 6*f*. Normally data "1" is set indicative of the precedence of the manual start mode.

The address of nonvolatile memory 212 which corresponds to, e.g., code "02," is stored with "0 to 5" (density is increased from initial value "6"), or "7 to 15" (density is reduced from initial value "6"), as data for fine adjustment of the exposure value for manual exposure for the copy scale factor of 141%. Thus, if copy key $6_1$ is turned on after "02" is entered as the input code, data "0 to 15" is displayed at display section 6f.

The address of nonvolatile memory 212 which corresponds to, e.g., code "06," is stored with "0 to 5" (density is increased from initial value "6"), or "7 to 15" (density is reduced from initial value "6"), as data for fine adjustment of the exposure value for automatic exposure for the scale factor of 141%. Thus, if copy key $6_1$ is turned on after "06" is entered as the input code, data "0 to 15" is displayed at display section 6f.

When the address data corresponding to the code indicative of the content to be modified is displayed at registered number display section 6f in this manner, the program proceeds to step ST3-7.

In step ST3-7, whether the contents of nonvolatile memory 212 should be modified is determined. If modification is needed, the program proceeds to step ST3-8. If not, the program proceeds to step ST3-9.

In step ST3-8, a set value different from the displayed data is entered by means of numeral-keys $6_2$. Then, the program proceeds to step ST3-10.

In step ST3-10, the set value is displayed at registered number display section 6f. Then, the program proceeds to step ST3-11.

In step ST3-11, whether the set value displayed at display section 6f is correct is determined. If the set value is correct, the program proceeds to step ST3-12. If not, the program proceeds to step ST3-9.

In step ST3-12, interrupt key 6d is turned on, for example. Then, the program proceeds to step ST3-13.

In step ST3-13, the set value is stored in a predetermined address of nonvolatile memory 212 in response to the on-operation of interrupt key 6d. If this is done, then the priority of selection corresponding to the aforesaid code is modified in accordance with the set value. Then, the program proceeds to step ST3-14.

In step ST3-14, characters "AJ" are displayed at registered number display section 6f. Then, the program proceeds to step ST3-15.

In step ST3-9, if clear key 6e is turned on, for example, the contents of nonvolatile memory 212 are regarded as unmodified. Then, the program proceeds to step ST3-14

In step ST3-15, whether the AJ mode should be canceled is determined. If the AJ mode is to be canceled, the program proceeds to step ST3-16. If not, the program proceeds to step ST3-3.

In step ST3-16, the AJ mode is canceled by simultaneously entering "0" and "9" by means of numeral-keys $6_2$, for example.

In step ST2, a timer (not shown) is started for counting. Thereupon (when the power is on), the operation of step ST4 is executed.

In step ST4, main processor group 164 determines whether the precedence-of-APS mode is established, on the basis of the data in nonvolatile memory 212. If the data stored in the address of memory 212 which corresponds to code "19" is "1," the APS mode is established, whereupon the program proceeds to step ST5. If the content of the address of memory 212 corresponding to "19" is changed to "0," that is, if the precedence-of-manual mode is established, the program proceeds to step ST6.

In step ST5, indicator 6q for automatic paper selection is turned on. Then, the program proceeds to step ST7.

In step ST7, the indicators of cassette display section $6_5$ which correspond to all of the sheet sizes set in the copying machine are turned on. In this case, if sheet cassettes 8, 10 and 18 are different in size, that is, if the sizes of the paper sheets in the three different cassettes are all different, a maximum of three indicators are simultaneously turned on. Then, the program proceeds to step ST8.

In step ST8, empty processes for sheet cassettes 8, 10 and 18 are executed, and indicators 6m, 6n and 6o, which correspond to sheet cassettes 8, 10 and 18 whose emptiness is detected by empty detectors 96, 98 and 100, respectively, are turned on. Then, the program proceeds to step ST9.

In step ST9, if automatic key 6p is turned on, the program proceeds to step ST10. If not, the program proceeds to step ST11.

Figures 1, 14C:
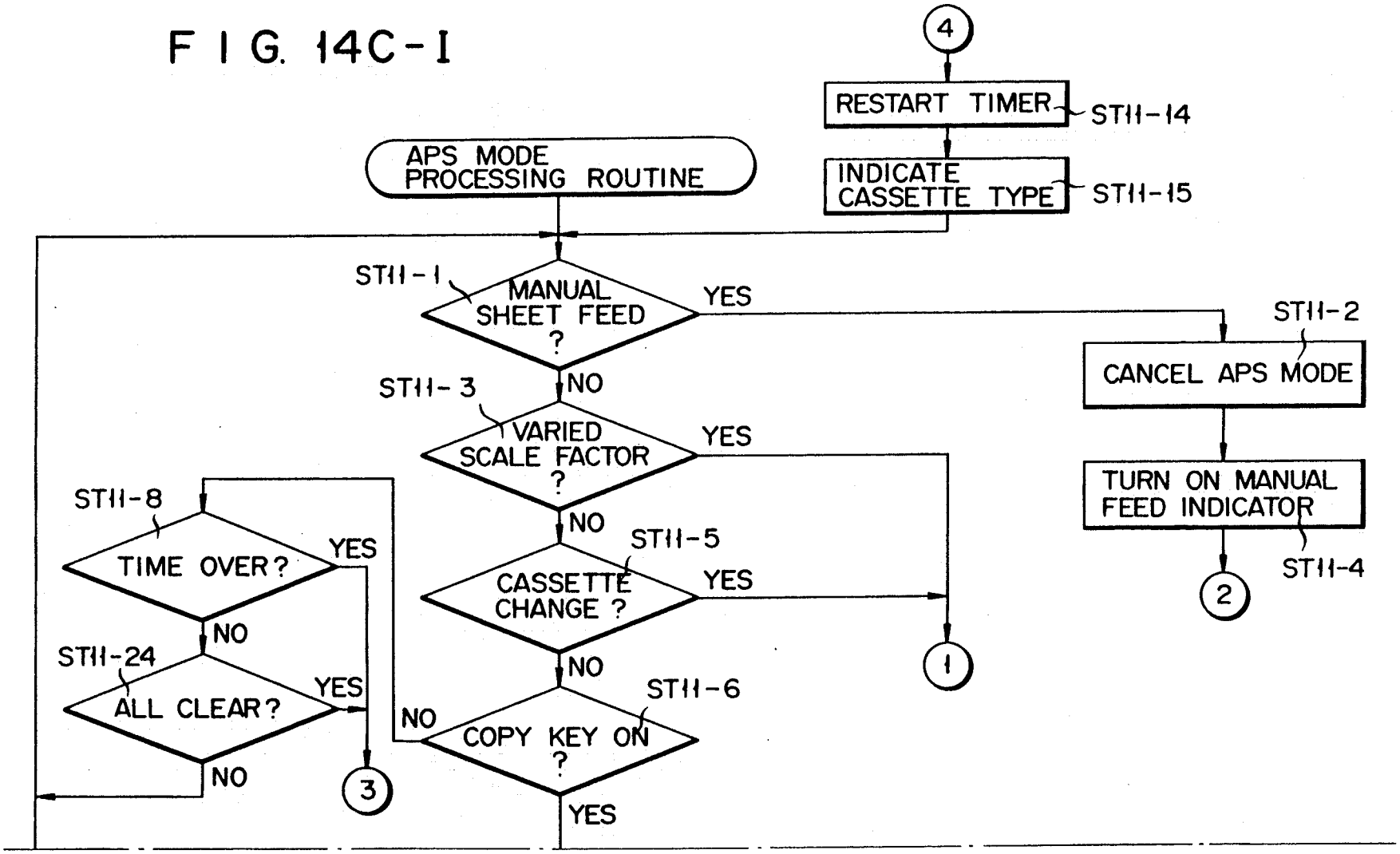

In step ST11 the APS mode processing routine shown in FIG. 14C is executed. Since the precedence-of-APS mode is normally established, this routine is started when the power is turned on, when the set time is over, or when the set conditions are all cleared. The details of step ST11 will be described later.

In step ST6, the manual mode is established, and indicator 6q for automatic paper selection and indicator 6r for automatic magnification section are both turned off. Then, the program proceeds to step ST12.

In step ST12, whether automatic key 6p is depressed once is determined. If key 6p is depressed once, the program proceeds to step ST13. If not, the program proceeds to step ST14.

In step ST13, the timer is cleared and then restarted for counting. Also, indicator 6q for automatic paper selection is turned on, and the operation mode is switched from the manual mode to the APS mode. Then, the program proceeds to step ST5.

In step ST14, whether automatic key 6p is consecutively depressed twice is determined. If key 6p is consecutively depressed twice, the program proceeds to step ST10. If not, the program proceeds to step ST15. Also if automatic key 6p is depressed once to cancel the mode, in step ST9, so that indicator 6q for automatic paper selection and a cassette-type indication at cassette display section $6_5$ are turned off, the program proceeds to step ST10.

In step ST10, the timer is restarted for counting. Then, the program proceeds to step ST16.

In step ST16, whether automatic key 6p is on is determined. If key 6p is on, the program proceeds to step ST17. If not, the program proceeds to step ST18.

In step ST17, the timer is restarted for counting. Then, the program proceeds to step ST6, whereupon the manual mode is restored.

In step ST18, indicator 6r for automatic magnification selection is turned on. Then, the program proceeds to step ST19.

Figures 1, 14D:
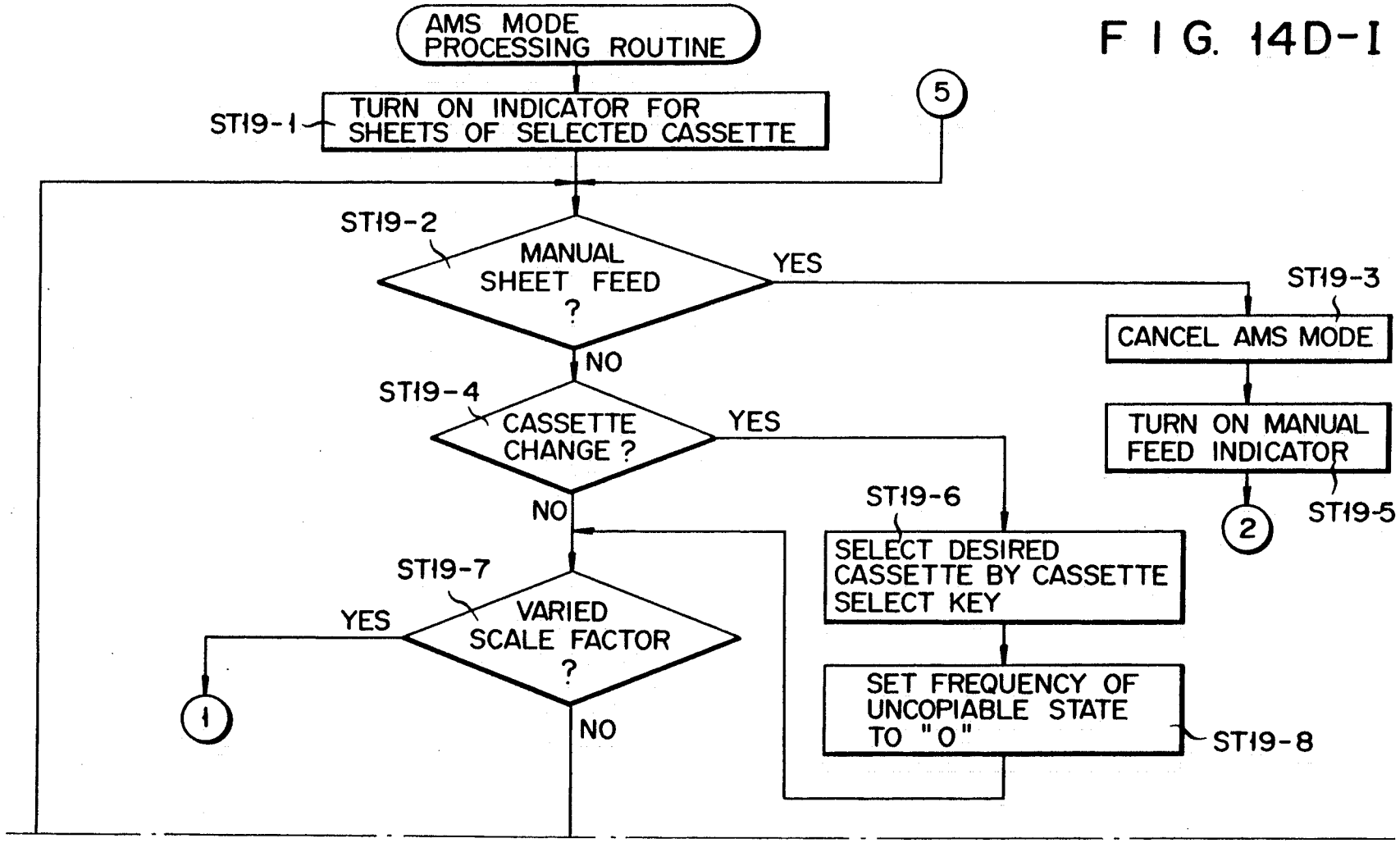

In step ST19, the AMS (automatic magnification selection) mode shown in FIG. 14D is executed. The details of step ST19 will be described later.

In step ST15, whether a paper sheet is manually fed through sheet-bypass guide 14 is determined. If manual sheet feed is executed, the program proceeds to step ST20. If not, the program proceeds to step ST21.

In step ST20, manual feed indicator 6i is turned on, whereupon the program proceeds to step ST22. In step ST22, main processor group 164 determines whether the precedence-of-automatic-start mode is established, on the basis of the data of nonvolatile memory 212. If this mode is established, that is, if the data stored in the address of memory 212 which corresponds to code "17"

is "0," the program proceeds to step ST23. If the precedence-of-automatic-start mode is not established, the program proceeds to step ST21.

In step ST21, whether copy key $6_1$ is on is determined. If key $6_1$ is on, the program proceeds to step ST23. If not, the program proceeds to step ST24.

In step ST23, the paper sheet supplied to sheetbypass guide 14 is automatically fed into the copying machine, whereupon the copying operation is started with previously selected conditions, including the scale factor, density, etc. If copy key $6_1$ is turned on, on the other hand, the copying operation is started with the scale factor, sheet size, etc. selected before the activation of key $6_1$. In this case, the original image may be formed on a sheet which is selected in accordance with the data stored in the address of nonvolatile memory 212 which corresponds to code "14". When the copying operation is finished, the program proceeds to step ST6.

In step ST24, whether the set time of the timer is over before copy key $6_1$ is turned on is determined. If the set time is over, the program proceeds to step ST2. If not, the program proceeds to step ST25.

In step ST25, whether the conditions are all cleared by operating clear key 6*e* twice is determined. If the conditions are all cleared, the program proceeds to step ST2. If not, the program proceeds to step ST6.

Referring now to FIG. 14C, the operation in step ST11, or APS mode, will be described.

In step ST11-1, whether a paper sheet is manually fed through sheet-bypass guide 14 is determined. If the manual sheet feed is executed, the program proceeds to step ST11-2. If not, the program proceeds to step ST11-3.

In step ST11-2, the APS mode is canceled, whereupon the program proceeds to step ST11-4.

In step ST11-4, indicator 6*q* for automatic paper selection and the cassette-type indication at cassette display section $6_5$ are turned off, and manual feed indicator 6*i* is turned on. Then, the program proceeds to step ST22.

In step ST11-3, whether the scale factor is changed by means of scale factor setting key $6_6$ or zoom key 67 is determined. If the scale factor is changed, the program proceeds to step ST6. If not, the program proceeds to step ST11-5.

In step ST11-5, whether the sheet size is changed by means of cassette select key $6_4$ is determined. If the sheet size is changed, the program proceeds to step ST6. If not, the program proceeds to step ST11-6.

In step ST11-6, whether copy key $6_1$ is on is determined. If key $6_1$ is on, the program proceeds to step ST11-7. If not, the program proceeds to step ST11-8.

In step ST11-7, the original size is detected by means of original detectors 160 and 162. If the APS mode is established, the presence of the original set on original table 20 before copy key $6_1$ is turned on is detected by means of original detectors 160 and 162, at the home position which corresponds to the scale factor of 100% (life size) for the sheet given preference in accordance with the data used to determine the priority of cassette selection, for example. The original size is detected by discriminating, by means of main processor group 164, the outputs of detectors 160 and 162 which accompany the movement of first carriage 44, switched in accordance with the result of detection of the presence of the original. Then, the program proceeds to step ST11-9.

In step ST11-9, whether a sheet feed cassette agreeable to the original size is set is determined. If it is concluded that the cassette corresponding to the original size is set, the program proceeds to step ST11-10. If not, the program proceeds to step ST11-11.

In step ST11-10, the cassette agreeable to the original size is automatically selected. Then, the program proceeds to step ST11-12.

In step ST11-12, the cassette-type indication is turned off, and only that indicator of cassette display section $6_5$ which corresponds to the sheet size of the cassette automatically selected in accordance with the original size is turned on. Then, the program proceeds to step ST11-13.

In step ST11-13, the copying operation is started, and the original image is formed life-sized on the automatically selected paper sheet. When the copying operation for a predetermined number of copies is finished, the program proceeds to step ST11-14.

In step ST11-14, the timer is restarted. Then, the program proceeds to step ST11-15.

In step ST11-15, the types of loaded cassettes are indicated at cassette display section $6_5$. Then, the program proceeds to step ST11-1.

In step ST11-11, whether there is a misalignment between the set original and the fed paper sheet is determined. If misalignment is detected, the program proceeds to step ST11-16. If not, the program proceeds to step ST11-17.

In step ST11-16, misalignment is indicated by a flickering of indicator 6*j* or 6*k* which corresponds to the original setting direction, and the copying operation is stopped. Then, the program proceeds to step ST11-18.

In step ST11-17, whether a cassette agreeable to the original size is set is determined. If it is concluded that an agreeable cassette is absent the program proceeds to step ST11-19. If no, the program proceeds to step ST11-20.

In step ST11-19, the absence of a cassette is indicated by flickering of the indicator of cassette display section $6_5$ which corresponds to the original size, and the copying operation is stopped. Then, the program proceeds to step ST11-18.

In step ST11-20, if the original size fails to be detected by means of original detectors 160 and 162, indicators 6*j* and 6*k*, which are indicative of the original setting direction, flicker, thereby indicating an error in original size detection, and the copying operation is stopped. Then, the program proceeds to step ST11-18.

In step ST11-18, whether a second uncopyable state is established is determined when the above process is repeated as copy key $6_1$ is turned on again. If a second uncopyable state is not detected, the program proceeds to step ST11-1. If the disabling condition, such as misalignment, absence of a cassette, or an original size detection error, is removed by changing the original setting direction (sheet feed direction is changed in the case of an original of size "A4" or "B4"), replacing the cassette, or detecting the original size, that is, if it is concluded in step ST11-9 that the cassette agreeable to the detected original size is set, the program proceeds to step ST11-10.

If a second uncopyable state is detected in step ST11-18, that is, if the uncopyable state is consecutively repeated, accompanying the same disabling condition, such as misalignment, absence of a cassette, or an original size detection error (or if copy key $6_1$ is turned on in the uncopyable state), the program proceeds to step ST11-21.

In step ST11-21, the cassette corresponding to the data stored in the address of nonvolatile memory 212 which corresponds to code "14" is automatically selected. Then, the program proceeds to step ST11-22.

In step ST11-22, only the indicator of cassette display section $6_5$ which corresponds to the sheet size of the selected cassette is turned on. Then, the program proceeds to step ST11-23. The details of steps ST11-21 and ST11-22 will be described later.

In step ST11-23, the copying operation is started, and the original image is formed same-size on the paper sheet automatically selected in accordance with the data used to determine the priority of cassette selection. When the copying operation for a predetermined number of copies is finished, the program proceeds to step ST11-14.

In step ST11-8, whether the set time of the timer is over before copy key $6_1$ is turned on is determined. If the set time is over, the program proceeds to step ST2. If not, the program proceeds to step ST11-24.

In step ST11-24, whether the conditions are all cleared by operating clear key 6*e* twice is determined. If the conditions are all cleared, the program proceeds to step ST2. If not, the program proceeds to step ST11-1.

Referring now to FIG. 14D, the operation in step ST19, or AMS mode, will be described.

In step ST19-1, only that indicator of cassette display section $6_5$ which corresponds to the currently selected cassette is turned on. Then, the program proceeds to step ST19-2.

In step-ST19-2, whether a paper sheet is manually fed through sheet-bypass guide 14 is determined. If manual sheet feed through guide 14 is executed, the program proceeds to step ST19-3. If not, the program proceeds to step ST19-4.

In step ST19-3, the AMS mode is canceled, whereupon the program proceeds to step ST19-5.

In step ST19-5, indicator 6*r* for automatic magnification selection and the indication at cassette display section $6_5$ are turned off, and manual feed indicator 6*i* is turned on. Then, the program proceeds to step ST22.

In step ST19-4, whether the cassette should be changed is determined. If the cassette is to be changed, the program proceeds to step ST19-6. If not, the program proceeds to step ST19-7.

In step ST19-6, the desired cassette is selected by means of cassette select key $6_4$, whereupon the program proceeds to step ST19-8.

In step ST19-8, that indicator of cassette display section $6_5$ which corresponds to the selected cassette is turned on, and the frequency of occurrence of the uncopyable state is set to "0." Then, the program proceeds to step ST19-7.

In step ST19-7, whether the scale factor is changed by means of scale factor setting key $6_6$ or zoom key $6_7$ is determined. If the scale factor is changed, the program proceeds to step ST6. If not, the program proceeds to step ST19-9.

In step ST19-9, whether copy key $6_1$ is on is determined. If key $6_1$ is on, the program proceeds to step ST19-10. If not, the program proceeds to step ST19-11.

In step ST19-10, the original size is detected by means of original detectors 160 and 162. If the AMS mode is established, the presence of the original set on original table 20, before copy key $6_1$ is turned on is detected by means of original detectors 160 and 162 at the home position which corresponds to the scale factor of 100% (life size) for the sheet size of the selected cassette, for example. The original size is detected by discriminating, by means of main processor group 164, the outputs of detectors 160 and 162 which accompany the movement of first carriage 44, switched in accordance with the result of detection of the presence of the original. When the original size detection is finished, the program proceeds to step ST19-12.

In step ST19-12, whether the copying operation with the copy scale factor based on the detected original size and the selected sheet size is possible is determined. If it is concluded that the copying operation is possible, the program proceeds to step ST19-13. If not, the program proceeds to step ST19-14.

In step ST19-13, the optical system and the like are moved so that the scale factor is automatically changed. Then, the program proceeds to step ST19-15.

In step ST19-15, the copying operation is started, and the original image is formed on the selected paper sheet, with a scale factor selected in accordance with the original size and the sheet size. When the copying operation for a predetermined number of copies is finished, the program proceeds to step ST19-2.

In step ST19-14, whether the scale factor is outside a predetermined adjustable-magnification range (e.g., from 65% (reduced scale) to 200% (enlarged scale)) of the copying machine is determined. If it is concluded that the scale factor is outside the predetermined range, that is, if the original size and the sheet size are extremely different, the program proceeds to step ST19-16. If it is concluded that the scale factor is within the predetermined range, the program proceeds to step ST19-17.

In step ST19-16, the optical system and the like are moved in accordance with the maximum or minimum scale factor. Then, the program proceeds to step ST19-18.

In step ST19-18, an unfitness of scale factor is indicated by flickering of the "200" (maximum) and the "65" (minimum indications. More specifically, if a scale factor smaller than 65% is selected by the automatic scale factor selecting function, "65" is flickered at scale factor display section $6_8$. If a scale factor greater than 200% is selected, "200" is flickered at section $6_8$. In both cases, the copying operation is stopped. Then, the program proceeds to step ST19-22.

In step ST11-17, whether there is a misalignment between the set original and the fed paper sheet is determined. If misalignment is detected, the program proceeds to step ST19-19. If not, the program proceeds to step ST19-20.

In step ST19-19, the optical system and the like are moved, so that the scale factor is automatically changed. Then, the program proceeds to step ST19-21.

In step ST19-21, misalignment is indicated by flickering of indicator 6*j* or 6*k*, whichever corresponds to the original setting direction, and the copying operation is stopped. Then, the program proceeds to step ST19-22.

In step ST19-20, if the original size fails to be detected by means of original detectors 160 and 162, indicators 6*j* and 6*k*, which are indicative of the original setting direction, flicker, thereby indicating an error in original size detection, and the copying operation is stopped. The, the program proceeds to step ST19-22.

In step ST19-22, whether a second uncopyable state is established is determined when the above process is repeated as copy key $6_1$ is turned on again, after the copying operation is stopped in the aforesaid manner. If a second uncopyable state is not detected, the program proceeds to step ST19-2. If a disabling condition, such as the unfitness of scale factor, a misalignment, or an original size detection error, is removed by changing the set scale factor or sheet size, changing the original setting direction (sheet feed direction is changed when the original is size "A4A" or "B4"), or detecting the original size, that is, if it is concluded in step ST19-12 that the copying operation with the copy scale factor based on the detected original size and the selected sheet size is possible, the original image is formed on the sheet, with the scale factor automatically selected in accordance with the original size and the sheet size, in steps ST19-13 and ST19-15.

If a second uncopyable state is detected in step ST19-22, that is, if an uncopiable state is consecutively repeated, accompanying the same disabling condition, such as the unfitness of scale factor, a misalignment, or an original size detection error (or if copy key $6_1$ is turned on in the uncopyable state), the program proceeds to step ST19-23.

In step ST19-23, the original image is formed on the currently selected paper sheet, with the currently selected scale factor. When the copying operation for a predetermined number of copies is finished, the program proceeds to step ST19-2.

In step ST19-11, whether the set time of the timer is over before copy key $6_1$ is turned on is determined. If the set time is over, the program proceeds to step ST2. If not, the program proceeds to step ST19-24.

In step ST19-24, whether the conditions are all cleared by operating clear key 6*e* twice is determined. If the conditions are all cleared, the program proceeds to step ST2. If not, the program proceeds to step ST19-2.

The functions of automatic paper selection and automatic magnification selection are also fulfilled in an interrupt mode established by operating interrupt key 6*d*. If the interrupt mode is canceled, the state before the activation of key 6*d* is restored. If an uncopiable state is caused before key 6*d* is turned on, however, the frequency of occurrence of the uncopiable state is cleared as the operation is restored from the interrupt mode.

Figure 15A:
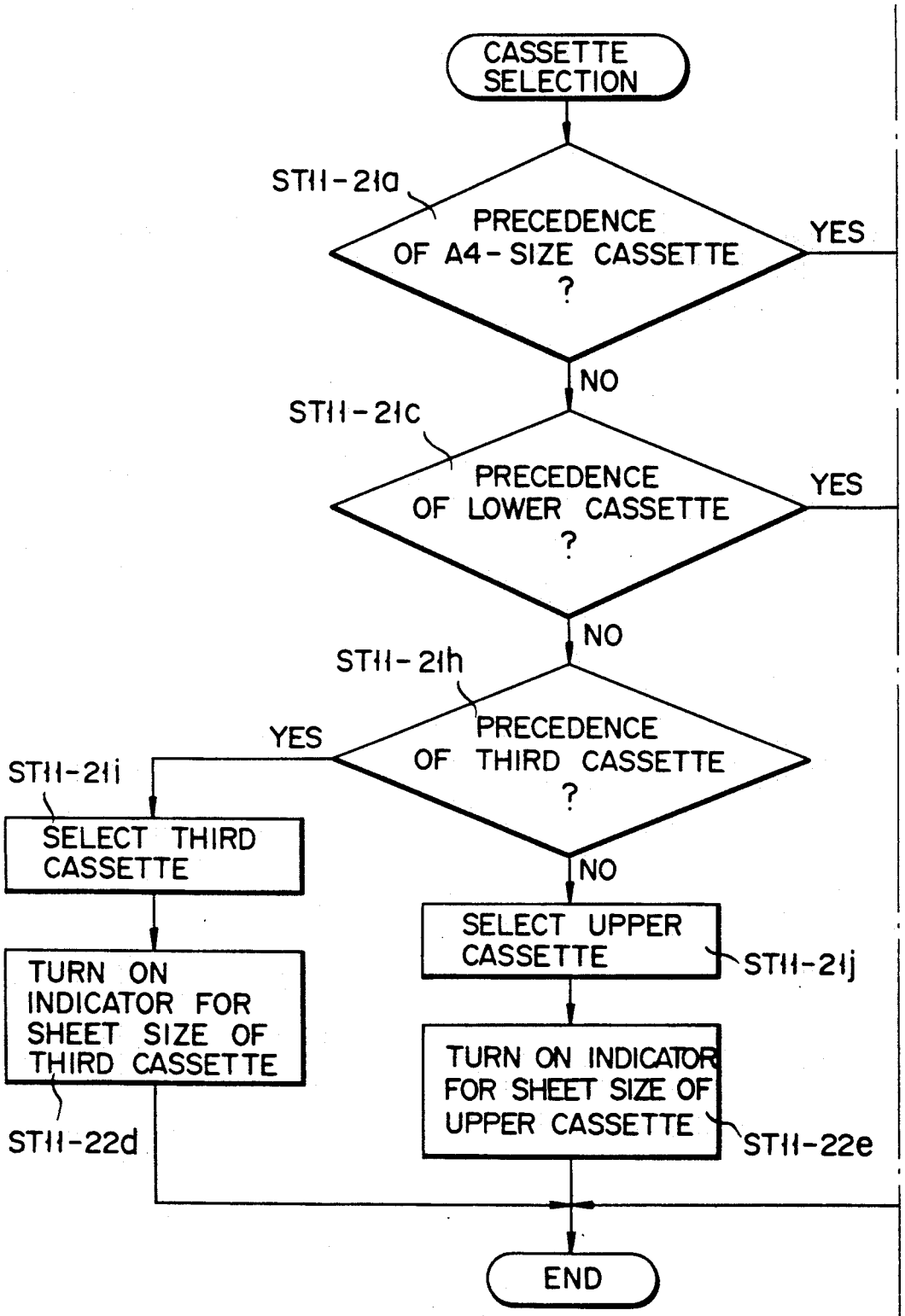
FIGS. 15A and 15B are flow charts for illustrating the priority-cassette selecting operation of the copying machine shown in FIG. 1.
Figure 15B:
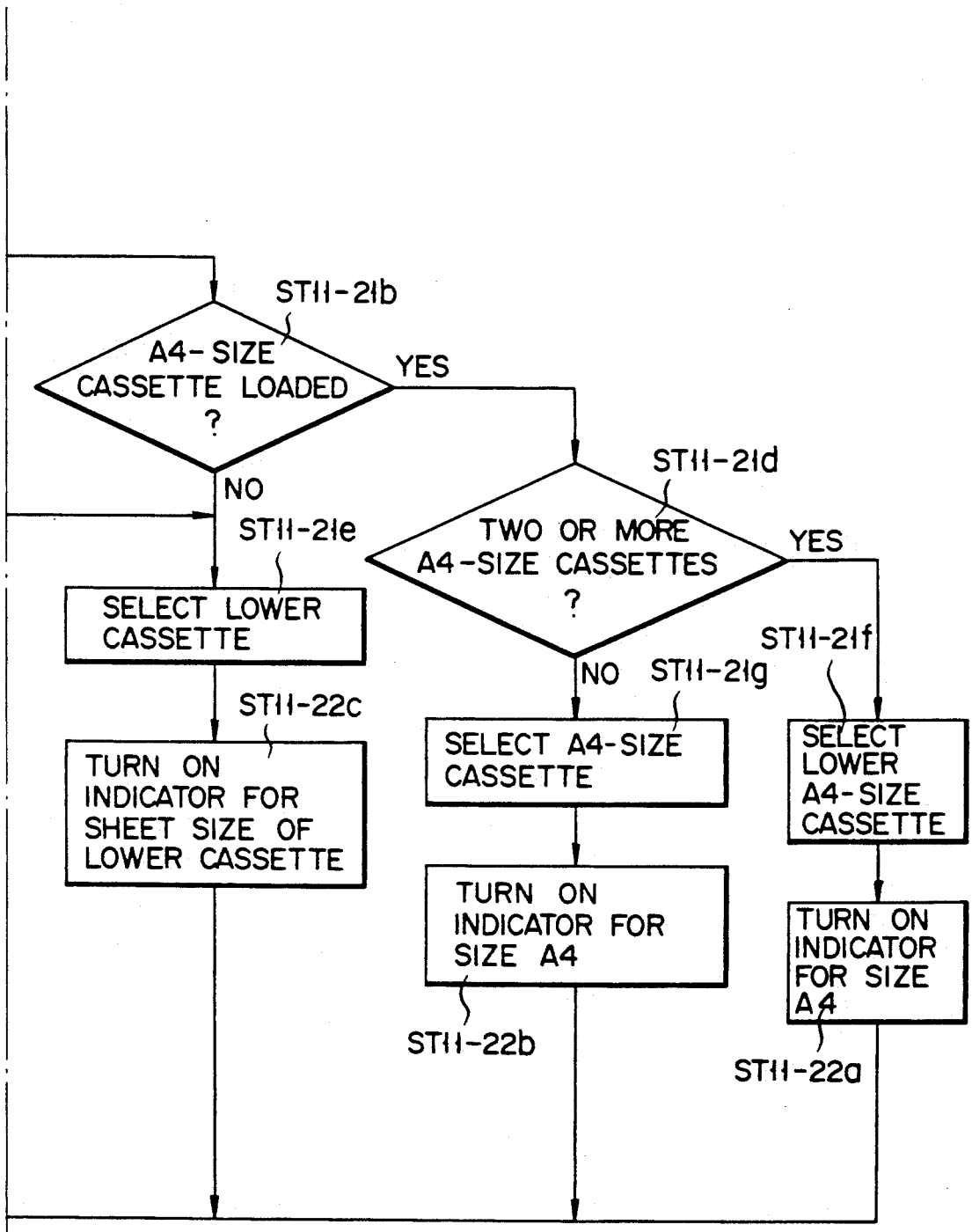

Referring now to FIG. 15, the operations in steps ST11-21 and ST11-22, or the selection of a priority cassette, will be described.

In step ST11-21*a*, data stored at the address of nonvolatile memory 212 which corresponds to code "14" is read out by main processor group 164. Based on data stored at that address, whether the A4-size cassette is to be given preference is determined. If the A4-size cassette is to be given preference, the program proceeds to step ST11-21*b*. If not, the program proceeds to step ST11-21*c*.

In step ST11-21*b*, whether the A4-size cassette is loaded is determined. If the A4-size cassette is loaded, the program proceeds to step ST11-21*d*. If not, the program proceeds to step ST11-21*e*.

In step ST11-21*d*, whether there are a plurality of A4-size cassettes is determined. If there are a plurality of A4-size cassettes, the program proceeds to step ST11-21*f*. If not, the program proceeds to step ST11-21*g*.

In step ST11-21*f*, a lower A4-size cassette is selected, whereupon the program proceeds to step ST11-22*a*.

In step ST11-22*a*, the indicator corresponding to size "A4" is turned on.

In step ST11-21*g*, the A4-size cassette is selected, whereupon the program proceeds to step ST11-22*b*.

In step ST11-22*b*, the indicator corresponding to size "A4" is turned on.

In step ST11-21*e*, lower cassette 10 is selected, whereupon the program proceeds to step ST11-22*c*.

In step ST11-22*c*, the indicator corresponding to the sheet size of lower cassette 10 is turned on.

In step ST11-21*c*, whether lower cassette 10 is to be given preference is determined on the basis of the data stored at the address which corresponds to code "14". If cassette 10 is to be given preference, the program proceeds to step ST11-21*e*. If not, the program proceeds to step ST11-21*h*.

In step ST11-21*h*, whether third cassette 18 is to be given preference is determined on the basis of the data stored at the address which corresponds to code "14". If cassette 18 is to be given preference, the program proceeds to step ST11-21*i*. If not, the program proceeds to step ST11-21*j*.

In step ST11-21*i*, third cassette 18 is selected, whereupon the program proceeds to step ST11-22*d*.

In step ST11-22*d*, the indicator corresponding to the sheet size of third cassette 18 is turned on.

In step ST11-21*j*, upper cassette 8 is selected, whereupon the program proceeds to step ST11-22*e*.

In step ST11-22*e*, the indicator corresponding to the sheet size of upper cassette 8 is turned on.

As a summary of the cassette selection, if the data is "3," for example, upper sheet cassette 8 is selected, and the indicator of cassette display section $6_5$ corresponding to the sheet size of cassette 8 is turned on. If the data is "2," third cassette 18 is selected, and the indicator of section $6_5$ corresponding to the sheet size of cassette 18 is turned on. If the data is "1," lower cassette 10 is selected, and the indicator of section $6_5$ corresponding to the sheet size of cassette 10 is turned on. If the data is "0," the cassette containing sheets of size "A4" is selected, and the indicator of section $6_5$ corresponding to size "A4" is turned on. If the copying machine is not loaded with the A4-size cassette, in this case, lower cassette 10 is selected, and the indicator of section $6_5$ corresponding to the sheet size of cassette 10 is turned on. If the machine is loaded with two or more A4-size cassettes, the lower or lowest A4-size cassette is selected, and the indicator of section $6_5$ corresponding to size "A4" is turned on.

In the automatic paper selection mode, as described above, the size of the original set on original table 20 is read, and those sheets corresponding to the original size, among the sheets of other types removably set in the copying machine, are automatically selected. Before the start of the copying operation, in this mode, the sizes of all the sheets set in the copying machine are indicated by means of their corresponding indicators in display section $6_5$. After the start of the operation, only the size of the automatically selected sheets is indicated by means of its corresponding indicator. Thus, the sizes of all the sheets set in the copying machine and the selected sheet size can be easily identified at a glance.

When the automatic paper selection mode is established, the operator is informed of all the types of the cassettes set in the copying machine by means of the indicators. If the copying machine is not loaded with sheets of the size corresponding to the original size, therefore, the operator can easily determine in advance whether the copying operation using the function of automatic paper selection is possible, before giving a command for the start of operation.

When the copying operation is started, moreover, only that indicator which corresponds to the selected sheet size is turned on. Accordingly, the operator can easily ascertain the selected sheet size.

In the embodiment described above, the original detectors used are of a type such that the original size is read as the optical system travels. The present invention is not limited to this arrangement, however, and the original size may alternatively be detected by means of sensors or the like attached to the original cover, for example.

It is to be understood, furthermore, that when the copying machine is not in the APS mode, the selected cassette can be freely changed despite a change of mode. While the precedence-of-APS mode is not established, moreover, the priority cassette may be selected when the power is turned on, when the set time is over, or when the set conditions are all cleared, for example.

What is claimed is:

1. An image forming apparatus comprising:

reading means for reading the size of an original;

holding means for holding sheets of a plurality of different sizes, said holding means including receiving sections each for receiving sheets of the same size;

indicating means for indicating the sizes of the sheets held in the holding means;

selecting means for automatically selecting the sheet of a size corresponding in size to the original and contained in the holding means, on the basis of a reading by the reading means;

control means for controlling the indicating means such that the indicating means indicates the sizes of all of the sheets contained in the holding means before start of an image forming operation, and indicates only the size of the selected sheets after the start of the image forming operation;

first memory means for storing image forming conditions; and second memory means for selectively establishing an image forming mode for executing image formation and an adjust mode for modifying data stored in the first memory means.

2. An image forming apparatus according to claim 1, further comprising:

first mode setting means for alternatively establishing a first mode in which the sheets of the size corresponding to the size of the original are automatically selected from the sheets contained in the holding means by the selecting means, on the basis of the reading by the reading means; and a second mode setting means for setting a second mode different from the first mode.

3. An image forming apparatus according to claim 2, wherein said control means controls the indicating means such that the indicating means indicates, the sizes of all of the sheets contained in the holding means before the start of the image forming operation, and indicates only the size of the selected sheets after the start of the image forming operation, when the first mode is established by the first mode setting means.

4. An image forming apparatus according to claim 3, wherein said control means controls the indicating means such that the indicating means indicates the first mode when the first mode is established by the first mode setting means.

5. An image forming apparatus according to claim 2, further comprising;

input means for entering image forming conditions into said first memory means.

6. An image forming apparatus according to claim 2, further comprising:

power switch means for connecting the image forming apparatus to a power supply; and input means for entering the image forming conditions;

said second mode setting means selectively establishing the image forming mode and the adjust mode when said power switch means is turned on, so that predetermined conditions are entered into said second mode setting means through the input means.

7. An image forming apparatus according to claim 6, wherein the input means includes numeral-keys for entering the image forming conditions, and said second mode setting means selectively establishes the image forming mode and adjust mode, when said power switch means is turned on, so that the predetermined conditions are entered through specific keys of the numeral-keys.

8. An image forming apparatus according to claim 1, wherein said holding means includes first container means for holding sheets of a first size and second container means for holding sheets of a second size.

9. An image forming apparatus according to claim 8, wherein said second memory means stores a priority of selection between sheets of the first and second sizes and sheets contained in the first and second container means when sheet selection by the selecting means is impossible, and wherein the selecting means preferentially selects sheets of a predetermined size, among sheets contained in the holding means, in accordance with memory contents of the second memory means, when normal sheet selection is impossible.

10. An image forming apparatus according to claim 1, wherein said selecting means automatically selects the sheet of another size contained in the holding means, when said holding means holds no sheets of the size corresponding to the size of the original.

* * * * *